US008287327B1

(12) United States Patent
Ghaly

(10) Patent No.: US 8,287,327 B1
(45) Date of Patent: Oct. 16, 2012

(54) INTERACTIVE PLAY SET

(76) Inventor: Nabil N. Ghaly, South Huntington, NY (US)

( * ) Notice: Subject to any disclaimer, the term of this patent is extended or adjusted under 35 U.S.C. 154(b) by 1476 days.

(21) Appl. No.: 11/888,466

(22) Filed: Aug. 1, 2007

Related U.S. Application Data

(60) Provisional application No. 60/834,824, filed on Aug. 2, 2006.

(51) Int. Cl.
*A63H 3/24* (2006.01)

(52) U.S. Cl. ..... 446/297; 446/330

(58) Field of Classification Search ..... 446/297
See application file for complete search history.

(56) References Cited

U.S. PATENT DOCUMENTS

| | | | | |
|---|---|---|---|---|
| 5,466,181 | A * | 11/1995 | Bennett et al. | 446/297 |
| 2002/0106964 | A1* | 8/2002 | Gaynor et al. | 446/330 |
| 2008/0014828 | A1* | 1/2008 | Kelly | 446/73 |
| 2009/0158210 | A1* | 6/2009 | Cheng et al. | 715/810 |

* cited by examiner

*Primary Examiner* — Tramar Harper

(57) ABSTRACT

An interactive intelligent play set, method and apparatus, is provided which includes a principle toy, a plurality of action figures, and/or play accessories. An intelligent play set identifies and tracks action figures and/or play accessories used by a player during a play session, provides interactions based on the specific action figures, accessories, or combinations thereof, used by a player during game play, provides interactions based on the history of how a player has interacted with the set during previous play sessions, and/or enables a player to construct new interactions between the various play pieces of the play set, using basic interactions as building blocks.

35 Claims, 24 Drawing Sheets

Figure – 17 –

INTERACTIVE PLAY SET

PARENT CASE TEXT

This utility application benefits from provisional application of U.S. Ser. No. 60/834,824 filed on Aug. 2, 2006.

BACKGROUND OF THE INVENTION

Play sets that include action figures and other playing pieces are becoming increasingly popular, and normally involve a primary toy, a plurality of action figures and/or a plurality of play accessories. An action figure could have a visual appearance that represents a person, an animal, or thing of an exciting nature, such as comic or movie characters, national heroes, monster figures, science fiction personalities, celebrities or the like. Action figures normally include articulated parts, and in the case of a human figure, articulated body parts such as arms, legs, head etc. Examples of toy action figures include dolls associated with play sets such as doll houses, kitchen sets, camping grounds, beach settings, or the like. Animal action figures are associated with play sets that include a farm, a zoo, a circus, etc. Hero action figures could be associated with battle ground play sets, rescue play sets, or the like. Most of these play sets are passive in that there is no centralized intelligence in a play set that detects how the child is playing with the various play set pieces, what specific play pieces (action figures and/or accessories) are being played with at a given time, or how the child has interacted with the play set during past play sessions. A child normally uses his or her imagination to interact the action figures and other play accessories with the primary toy in a playing set. Further, there could be a number of playing activities that involve accessories associated with either the primary toy, and/or the action figures. For example, an action figure doll with a plurality of clothing accessories, a toy car with a plurality of traffic signs, a rescue action figure with a plurality of rescue tools, etc.

To enhance the play value of play sets, it is desirable to keep track of what specific play pieces are being used by a child at a given point in time, and how the child is playing with these pieces. It is also desirable to link current interactions to the history of how the child has interacted with the play set in the past. Such intelligence would allow the development of more interactive play sets that challenge players to perform certain activities or tasks, and to also provide feedback to the player based on how the player is interacting with the play set, or has interacted with the play set in prior play sessions. To implement this intelligence feature, it is desirable to simultaneously identify multiple playing pieces, in real time, without constraining the child from moving the pieces around the play set. It is, also, desirable to minimize plugging in accessories into either action figures or the main toy setting unless such plug-in accessories are part of the play pattern for a play set. Further, it is desirable that such identification is implemented in a cost effective way, and preferably without the use of battery operated action figures or accessories.

There are a number of options to interconnect elements of a play set together. For many years, wireless remote control apparatus that employ modulated radio frequency signals were used to send and receive information between elements of a play set, such as a remote control toy car, racing cars, and the like. Similarly, infrared ("IR") communication devices have been used for remote control applications, and to provide communications between two similar devices. For example in applications that provide interactions between two similar dolls, IR technology is used to transmit and receive control signals between the two doll devices. Also, magnetic coupling has been used to identify various play pieces to a primary toy device in a play set. More recently, passive Radio Frequency Identification ("RFID") technology has matured to become a cost effective wireless communication alternative for the identification, and tracking of action figures, and accessories in a play set. Other technologies available for identification, and tracking of play pieces include bar coding, laser scanning, and mechanical configurations that activate a plurality of micro switches.

The main focus of the invention herein is to provide intelligent play sets that employ a plurality of play pieces, wherein each play piece, or a combination of play pieces, affect the functionality of the play set, and wherein the play pattern is personalized to the manner in which a player has interacted with the play set during previous play sessions. Further, the present invention enables players to program new interactions for a play set using basic interactions as building blocks.

OBJECT OF THE INVENTION

This invention relates to toys, and in particular to play sets that involve action figures and/or accessories. Unlike most play sets, which are passive and do not provide interactive play, one object of this invention is to provide play sets with intelligence that identifies and tracks the various play set pieces during game play.

It is also an object of this invention to provide play sets that employ a wireless communication system, which includes a probe that transmits a modulated radio frequency request signal, and receives modulated radio frequency response signals from a plurality of passive tags located on, or associated with play pieces.

It is a further object of this invention to provide play sets, wherein a play set is capable of identifying action figures and accessories associated with the play set, and generating interactive play based on the specific play pieces that are being used by a child at a given point in time.

It is another object of this invention to provide play sets that employ a primary toy, action figures and accessories, and wherein an action figure, or a combination of an action figure and an accessory, or a plurality of accessories, affect how the primary toy interacts with the action figures.

It is still an object of this invention to provide play sets with a plurality of action figures and/or accessories, wherein each action figure and each accessory includes a passive radio frequency identification tag capable of storing information that identifies the play piece, and/or describes attributes and features associated with the play pieces.

It is also an object of this invention to provide play sets with a plurality of action figures, and/or accessories, wherein a play set is programmed to provide a plurality of interactive plays, and wherein the specific action figure, and or accessory, used by the player determines which interactive play is executed by the play set.

It is a further object of this invention to provide play sets that employ a plurality of action figures and accessories, wherein a play set is programmed to memorize play patterns used by the child, including the grouping of specific action figures and/or accessories during previous play sessions.

It is an additional object of this invention to provide play sets that employ a primary toy, a plurality of action figures, and a plurality of playing accessories, and wherein a player can define interactions unique to individual action figures, or combination of action figure and a playing accessory.

It is still an object of this invention to provide examples of play sets that employ the various concepts disclosed herein.

It is another object of this invention to provide a first example of an interactive play set that employs a plurality of action figure dolls, as well as a plurality of clothing, and fashion accessories, wherein the child is challenged to dress up an action figure doll, and wherein the play set is programmed to evaluate, and provide feedback on how the child has matched the various items of clothing and fashion accessories with an action figure.

It is also an object of this invention to provide a second example of an interactive play set that includes a motorized toy vehicle, and a plurality of traffic signs and other play accessories that affect the operation of the vehicle when placed at close proximity to its path, and wherein the vehicle device can memorize various configurations of traffic signs and/or play pieces used by the child in previous play sessions.

It is an additional object of this invention to provide a third example of an interactive play set that includes an interactive doll device as a primary toy, and wherein a plurality of clothing and fashion accessories are used to affect the way the doll device interacts with a child.

It is still an object of this invention to provide an example of an interactive play set that employs the radio frequency identification technology, and which further interacts with a similar device using infra red, or other form of communication.

It is also an object of this invention to provide a fourth example of an interactive play set that includes a toy pet, and a plurality of accessories, and wherein an accessory affects the operation of the toy pet when placed in proximity of the toy pet device.

It is another object of this invention to provide an interactive play set, which includes a primary toy, and a plurality of play accessories, wherein the primary toy includes a RFID reader, and each play accessory includes a passive RFID tag, and wherein a play accessory further includes a mechanism that controls a shield for the RFID tag to make it active or inactive.

It is a further object of the invention to achieve the above objectives in an economical and easy to implement fashion.

SUMMARY OF THE INVENTION

The foregoing and other objects of the invention are achieved in accordance with one preferred embodiment of the invention by providing a plurality of doll action figures, and a plurality of clothing and fashion accessories, such as dresses, pants, blouses, shoes, hand bags, hats, jewelry, and the like. Each action figure and each piece of accessory is equipped with a passive radio frequency identification tag, and each of these tags has a unique identification code to identify an action figure or an accessory piece to a main play set. Two intelligent, fashion related play sets are disclosed in this preferred embodiment.

The first play set is in the form of a "magic" mirror with a surface that is both reflective and transparent. When the mirror device is not activated, said surface has a shining characteristic to reflect an object placed in front of it. Also, upon activating the mirror device, a back light within the mirror device illuminates, and the surface of the mirror becomes transparent to reveal an image within the mirror device.

The mirror device is equipped with a RFID interrogator (reader) that emits an active RF field through an antenna mounted within, or on the mirror housing. The mirror device also includes a microprocessor with a read only memory (ROM) to store a control program, and a data base that includes descriptive information related to the doll action figures, and all accessories associated with the play set. Further, the microprocessor is capable of generating digitized pre-recorded speech messages through a speaker located beneath the housing of the mirror device.

The player is instructed to dress up a doll action figure with matching clothing and accessories, and to place it in front of the mirror. Then upon pressing a start button located on the mirror device, a voice is generated from the mirror housing, depicting the doll action figure, and pausing the question, "mirror - - - mirror on the wall, who is the most fashionable of all?" The microprocessor in the doll device then activates the RFID interrogator, which in turn transmits a modulated radio frequency request signal to energize the RFID tags located on the doll action figure, and associated accessories, and which are within the coverage area of the RFID interrogator. Each RFID tag uses the radio frequency energy received from the interrogator to reflect back to the interrogator the digital information encoded in the tag. The interrogator then receives a plurality of modulated radio frequency responses from the various RFID tags. These responses are demodulated, and the digital information encoded in the various tags is then fed to the microprocessor to identify the doll action figure, and all clothing accessories used to dress it up.

Because the doll action figures and all accessory pieces are uniquely identified, the microprocessor is programmed with intelligence to evaluate the specific clothing combination used by the child to dress up the action figure. This evaluation includes factors such as color coordination, style, matching pieces, fashion trend, etc. One design choice to implement such evaluation is to create a data base of all possible combinations of action figures and accessories such that upon the detection of a specific combination, the microprocessor retrieves a corresponding entry in the data base, and the play set generates a pre-recorded verbal statement that analyzes the clothing & fashion accessories used by the child. Such pre-recorded voice generated message could be personalized to the doll action figure. The analyses are designed to provide feedback to the child related to the fashion choices used, and to critique in a positive way the child's selection of clothing and accessories.

As part of the analyses, the mirror device provides the child with a predetermined score associated with the selected clothing combination. This score reflects how fashionable and well dressed the doll action figure is. Because the mirror device is programmed to generate audio and visual effects prior to providing the verbal analysis, it would appear to the child that the feedback is provided in real time. A child can continue to play with the mirror play set using different combinations of clothing & accessories, or with different action figures, each with unique clothing. The device is also programmed to remember the various combinations of doll action figures/accessories used by the player in various playing sessions, and to announce to the player "who is the most fashionable of all," i.e., the name or identity of the doll action figure with the highest score.

It should be noted that the use of RFID technology to provide the identification of the various play pieces is set forth solely for the purpose of describing the preferred embodiment, and is not intended to limit the invention herein. As would be appreciated by one skilled in the art, alternate communication and/or identification technologies could be used to interconnect the various elements of a play set, and/or to identify various play pieces to a primary toy device.

The second play set, also, employs action figures, clothing & fashion accessories, and is in the form of a stage for fashion competition. This play set could be used by a single player, or could provide a challenge for a plurality of players to play a game of fashion competition. This second play set comes with six different dolls, and a plurality of clothing & fashion accessories. Similar to the mirror device, each action figure, and each accessory piece is tagged with a passive RFID tag. The stage for the fashion competition has two sections. The first section is designed as a walking path for the child to move a dressed up doll along the path, and incorporates the RFID interrogator and its antenna. The second section is in the form of a semi-circle structure that is attached at its center to the walking path. The semi-circle structure has six (6) positions to place the six dolls. Further, these positions are marked so that each doll has a specific position on the stage.

The child is instructed to dress up each doll, walk it on the pathway, and then place it at its designated position on the stage. Upon completing this first phase of play, the child is instructed to activate a "judge" button for the play set to announce the winner of the fashion show. During said first phase of play, and as the child is walking a doll on the pathway, the RFID interrogator scans the doll to identify it, and to capture the digital information encoded on the various tags attached to the doll's clothing and accessories. This information is then fed to the microprocessor, and based on the combination of clothing used a score is fetched from the data base stored in ROM. After all dolls are placed at their respective positions on the play set, and after the child activates the "judge" button, the play set generates a plurality of audio/visual effects, and then announce the winners of the fashion show starting with the second runner up, the first runner up, and the "Fashion Queen," the winner of the fashion show.

The above described play set could also be used by a plurality of players to play a game of fashion competition. In such a game, each player selects an action figure, and is instructed to dress up the action figure with matching clothing and fashion accessories. Each player then walks an action figure on the stage, and places it at the designated position on the semi circle structure. Upon completing this first phase of game play, and the activation of the "judge" button, the winner of the fashion competition is announced.

The objectives of the invention can also be achieved by a first alternate embodiment that includes a motorized toy vehicle, and a plurality of traffic signs and other play pieces. The toy vehicle includes a microprocessor that controls its speed, steering mechanism, and movement direction. The toy vehicle also includes an RFID interrogator and its antenna. Each traffic sign, and each play piece has a passive RFID tag with a unique identification code. The child is instructed to place the traffic signs in the path of the motorized toy vehicle in order to "program" the movement of the toy vehicle. As the toy vehicle approaches a traffic sign, the RFID interrogator transmits a modulated radio frequency request signal to energize the RFID tag located on the traffic sign. In turn, the RFID tag uses the radio frequency energy received from the interrogator to reflect back to the interrogator the digital information encoded in the tag. The interrogator then receives a modulated radio frequency response from the traffic sign RFID tag. This response is demodulated, and the digital information encoded on the tag is fed to the microprocessor to identify the traffic sign.

Upon the identification of a traffic sign, the microprocessor executes a control program segment that implements the traffic command indicated on the sign. For example, if the traffic sign indicates a left turn, the microprocessor executes a control program segment that causes the steering mechanism of the car to turn the car to the left. Similarly, if the traffic sign indicates a stop command, the microprocessor executes a program segment that causes the car to stop for a few seconds then proceed with its forward movement. In addition to left turn, right turn, U turn, and stop signs, the accessories could also include speed signs that instruct the vehicle to slow down, or to increase speed. Other traffic signs could include signs to instruct the vehicle to turn its headlights "ON" and "OFF," and to activate its horn.

During a play session, the vehicle device is programmed to memorize the motion profile corresponding to the configuration of traffic signs used by the child. A motion profile could be retrieved, and played back by the child during a subsequent play session. The vehicle device could be in the form of a passenger car, a military vehicle, a rescue vehicle, a bus, a taxi, or a action character vehicle such as a Batman vehicle. Additional play pieces, including action figures, could also be included in the play set. For example, for a vehicle in the form of a taxi, a plurality of action figures could be included in a play set to depict passengers, and a plurality of play pieces in the form of building models could be used to depict destinations for said passengers. As part of the play pattern, the child is instructed to program a "trip" for a passenger using a remote control apparatus, and/or a plurality of traffic signs. A trip is in the form of a motion profile that is associated with an action figure passenger, and it includes a series of direction, speed, and steering commands that moves the vehicle from a starting point to a destination point. Once a trip has been programmed by a player, it could be played back at a later play session.

Further, the objective of the invention can be achieved by a second alternate embodiment that includes a toy pet, such as an animal, a fictitious character, or the like, and a plurality of accessories. The toy pet could be mechanized, or could interact with the child verbally. For example, a mechanized toy dog could generate a barking sound, wig its tail, move its ears, and blink its eyes. The accessories could be in the form of written cue cards that instruct the dog to perform one of the above listed tricks. Alternatively, some of the accessories could be in the form of playing pieces associated with a dog, such as dog food items, other animal figures that include a cat, a mouse, and the like. The dog device includes an RFID interrogator and its antenna. Each cue card and each playing piece has a passive RFID tag with a unique identification code. The child is instructed to place the cue card or the playing piece in front of the dog device so that the dog can read it, and perform the required trick or action. As the child brings the cue card or a playing piece closer to the dog device, the RFID interrogator transmits a modulated radio frequency request signal to energize the RFID tag located on the cue card or the playing piece. In turn, the RFID tag uses the radio frequency energy received from the interrogator to reflect back to the interrogator the digital information encoded in the tag. The interrogator then receives a modulated radio frequency response from the cue card or the playing piece RFID tag.

This response is demodulated, and the digital information encoded on the tag is fed to the microprocessor to identify the specific cue card used by the child. This information can then trigger the required action by the dog device. For example, if a cue card instructs the dog to bark, then a microprocessor within the dog device executes a program segment that generates a barking sound. It should be noted that a speech recognition module could also be used with this dog device to interpret voice commands from the player. A voice command would then trigger a pre-programmed action by the dog device.

The cue cards and other playing pieces could also be used by the player to program new interactions for the dog device, using certain basic interactions as a building block. For example, a player can program a new interaction for an action figure tin the form of a cat. Such new interaction would include a sequence of basic interactions, such as the generation of a barking sound, a movement of the ear, and generating a growling sound. The player is instructed to flash the cat action figure, and various cue cards that correspond to the desired basic interactions, in a predefined sequence, in front of the dog device. The new interaction is then stored in the memory of the dog device, and is triggered any time the cat action figure is placed at close proximity to the dog device.

In a variation of this second alternate embodiment, a talkative bear that employs the RFID technology is controlled by a plurality of cue cards. Each cue card includes a passive RFID tag, and has a written question for the bear to answer. A question could be a simple math problem, or a general trivia question. Upon the identification of the cue card used by the child, the bear device provides an answer to the question written on the card, such that it would appear to the child that the bear is reading and answering various questions. Similar to the dog device, a player could program new interactions for the bear device using basic interactions as building blocks.

Cue cards and other playing pieces could incorporate a mechanism that activates and de-activates a shield for the passive RFID tag. Such mechanism could be in the form of a mechanical lever that moves a shield material such that it covers and uncovers the RFID tag. When the tag is covered, the shielded material prevents the radio frequency energy from reaching the tag. Alternatively, when the tag is uncovered, it will receive the radio frequency energy generated by the interrogator, and will transmit the digital information encoded in it. For example, the toy pet play set could incorporate an animated cue card. An animated cue card includes a tab that when moved by the player will cause an animation in the image provided on the cue card. This tab could also move an internal shield that covers and uncovers the passive tag. Other play pieces could include a battery operated mechanism to activate the shield.

In addition, the objective of the invention can be achieved by a third alternate embodiment that consists of an interactive doll as a primary toy device, and a plurality of clothing and fashion accessories. The doll device includes a RFID interrogator and an associated antenna. Each piece of clothing and fashion accessory has a passive RFID tag with a unique identification code. The doll device, also, includes a microprocessor programmed with intelligence that enables the doll device to memorize combinations of clothing, and fashion accessories presented to it by a player. The child is instructed to place each piece of accessory, or a group of accessories, in front of the doll device in a play role, or a play pattern, that informs the doll that the child has purchased new clothing for the doll. The child is also instructed to activate a button on the doll device so that the doll could acknowledge its new clothing and/or fashion accessories. Upon the activation of such button, the RFID interrogator transmits a modulated radio frequency request signal to energize the RFID tags located on the clothing accessories. In turn, the RFID tags use the radio frequency energy received from the interrogator to reflect back to the interrogator the digital information encoded in the tags.

A microprocessor inside the doll device establishes a data base of clothing accessories that were presented to the doll. The doll is programmed to initiate a plurality of interactions related to such clothing. For example, the toy device could generate one of a plurality of pre-determined verbal statements admiring, or commenting on its new clothing. Alternatively, the doll toy device could generate an interaction requesting the child to dress it with a particular item of clothing, or a combination of clothing accessories. Further, the doll device can detect a missing piece of clothing, or a missing fashion accessory from a set, and request the child to provide said missing piece or accessory. Also, during game play, the doll device is programmed to provide verbal feed back to the child in the event a piece of clothing, or a piece of fashion accessory, which does not belong to a clothing set, is used to dress up the doll.

The new clothing could be in the form of a matched set of individual pieces of clothing, and fashion accessories. For example, a new clothing set could consist of a dress, a matching pair of shoes, a matching hand bag, and a matching hat. In such a case, each piece of clothing has a unique identification code that is stored in the associated RFID tag. Further, the various identification codes that belong to a set of clothing could be linked together in a data base, to identify to the doll device that the associated pieces are part of said set.

In an alternate mode of operation, the microprocessor could include a data base, stored in its read only memory (ROM), and which include descriptive information of available clothing and accessories that are associated with the primary interactive doll device. Such clothing and accessories would be available in the market place, but not yet purchased and presented to the doll device as new clothing. From time to time, and preferably using a random algorithm, the doll device would generate an interactive play session, during which it relays to the child its desire to get a specific piece, or set of clothing. Such request would be remembered by the doll device, and the doll device will generate appropriate appreciative comments in the event the child provides the requested clothing or accessories to the doll. Alternatively, the doll device could generate comments to remind the player of its request.

The above described doll device could be further developed to interact with a similar device, using communication modules such as infra red technology, or the like. In such a case each doll device provides verbal interactions related to the clothing worn by the other doll device. One way to implement such interaction is to use infra red communication to identify the dolls to each other, and communicate verbalized statements to each other in order to generate reply statements. Upon the detection of another doll device, using an RFID interrogator, each doll device scans the clothing worn by the other doll device in order to identify said clothing, and to generate an appropriate verbalized comment using predefined scripts stored in the data base for the doll device. The microprocessor is programmed to differentiate between its own clothing, and the clothing worn by another doll.

Obviously, and as would be appreciated by a person skilled in the art, the above described concept of a doll device could be expanded beyond clothing and fashion accessories. For example, the interactive doll device could be associated with a plurality of non-clothing accessories such as toys, pieces of furniture, pets, or the like. Similar to the clothing and fashion accessories, such additional accessories could be presented to the doll device as new items, or could be stored in a data base within the doll device.

It should be noted that the above described embodiments, and examples are provided for the purpose of describing the current invention, and are not intended to limit the invention herein. As would be appreciated by a person skilled in the art, many more interactive play set embodiments could be constructed with intelligence to interact with a plurality of accessories, and to also memorize past interactions with a player. Such accessories could be in the form of action figures, or any other play pieces. An RFID identification system, or any other identification and/or communication technology, could be used to enable a primary play device to identify and track the specific play piece, or pieces, used by the child in a play session. A microprocessor is also used to adjust the operation, or functionality of the primary play device based on said specific play piece or pieces. The microprocessor is also programmed to memorize past interactions between the player and the play set, and to employ data related to previous interactions in subsequent interactions.

BRIEF DESCRIPTION OF THE DRAWINGS

These and other more detailed and specific objectives will be disclosed in the course of the following description taken in conjunction with the accompanying drawings wherein.

DESCRIPTION OF THE PREFERRED EMBODIMENT

Figure 1:
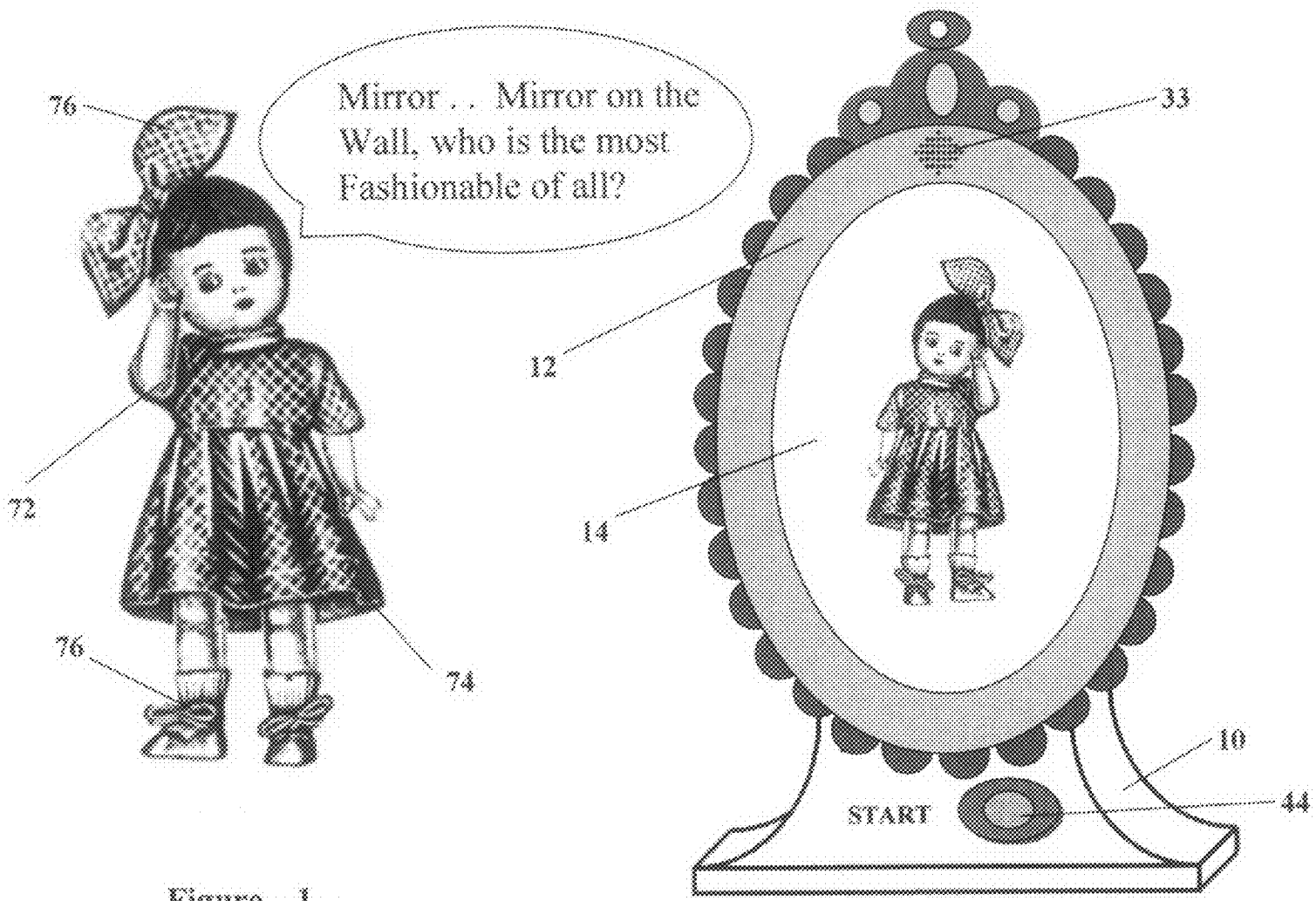
FIG. 1 is a view of the preferred embodiment of a mirror device play set showing an action figure dressed with clothing and fashion accessories, and placed in front of the mirror depicting an interaction according to the invention.

Referring now to the drawings where the illustrations are for the purpose of describing the preferred embodiment of the invention, and are not intended to limit the invention hereto, FIG. 1 is a view of the primary toy in this play set in the form of a mirror device 10 comprising a housing having an oval shaped mirror 12 with a glittery front surface 14 that reflects an item placed in front of it. This glittery surface becomes transparent upon the activation of a light emitting module 28 within the compartment of the mirror device 10. The back of the mirror device is shaped as a rectangular box 16, which houses the microprocessor, and other electronic circuitry that controls the operation of the device. This box also includes a battery compartment, a radio frequency identification ("RFID") interrogator 52 and associated antenna 50, as well as audio circuits 40 and associated speaker 32 that generates verbal communications and other audio effects through perforations 33 located on the frame of the mirror 12. In addition, the mirror device includes a plurality of light emitting means 30, preferably in various colors, to provide visual effects during a play session. Such light emitting means could be provided by light emitting diodes, or any other structure that generates light.

The operation of the mirror device is controlled by a microprocessor having a central processing unit (CPU) 60, an internal read only memory (ROM) 62, a random access memory (RAM) 64, and an external plug-in flash memory 66. The functions of the mirror device are provided by a control program that resides in ROM 64, and which receives an input command from a "START" switch 44. The mirror device has two main switches, an "ON/OFF" switch 16 that controls the connection of the battery to the internal electronic circuitry and other components, and the "START" push button 44, which when activated by a child initiates a play session. A third switch is provided to select a time period for a featured play pattern 46. In addition, a "RESET" switch 48 is provided to erase stored information related to past interactions from the memory of the device.

This mirror device is the primary toy in a play set that, also, includes a plurality of doll action figures 72, a plurality of clothing sets 74, and a plurality of fashion accessories 76 such as hand bags, hats, shoes, jewelry and the like. Each action figure 72 is identified by a play name, and the clothing sets 74 together with the various fashion accessories 76 are described in terms of style, color, mode, occasion, season, and the like, in a data base that is stored in the memory of the microprocessor. Further, each action figure 72, and each piece of clothing 74 and fashion accessory 76 is equipped with a passive RFID tag 80 that stores a unique code that identifies the action figure/clothing and fashion accessory. The main focus of play is fashion coordination playing with dolls, clothing and accessories. The play pattern requires a child to dress up one or more action figures with clothing sets and associated accessories, and place the dressed action figures, one at a time, in front of the mirror device 10 in order to initiate a play session during which the mirror device interacts with the action figure. During an interaction, the mirror device generates verbal statements that include observations, critiques and/or evaluations of the clothing used by the child to dress up the action figure. In turn, the mirror device 10 is programmed to recognize the combination of clothing 74 and fashion accessories 76 associated with an action figure 72, to analyze the combination of clothing, and fashion accessories using a number of parameters, and to provide verbal feed back to the player related to said combination of clothing and accessories. The mirror device is also programmed to memorize the combinations of action figures/clothing/accessories used by the child during various play sessions in order to provide comparative, or relative evaluations between said various combinations during game play. Such comparative evaluations could be based on various time periods. For example, the time period could be one play session. Alternatively, the time period could be a calendar day, a week, a month, or a continuing period commencing from the time the child first played with the play set. The child is instructed to establish such time period using a selector switch 46 before the start of a play session. At any time, the player can erase stored information related to past interactions by activating the "RESET" button 48.

It should be noted that in lieu of incorporating the "START" button 44 in the mirror device 10, each doll action figure 72 could act as a remote control module to activate the mirror device. In such a case, a "START" button located on each doll action figure could be used to initiate a play session. Further, an infra red ("IR") module, or other communication module, could be used to transmit a signal to the mirror device upon the activation of said "START" button.

The microprocessor that controls the mirror device, also, interfaces with a plurality of light emitting means 30 for generation of visual effects, as well as with a speaker 32 that generates verbal interactive messages, and other sound effects. Further, the microprocessor interfaces with the RFID interrogator 52, which in turn is connected to an RFID antenna 50 located within the mirror device. A removable flash memory 66 is used to provide a non volatile memory storage that is not affected when the power for the mirror device is turned off, or if the battery that provides electrical power for the device is removed. The flash memory 66 could also be used to provide additional data base information related to additional doll action figures, descriptive information related to additional clothing and/or fashion accessories, as well as pre-programmed verbal statements corresponding to various combinations of said additional clothing items.

Radio frequency identification is a method to remotely collect data using radio waves to track, monitor, identify or categorize objects. Upon the activation of the START button 44, and as part of a play cycle, the microprocessor instructs the RFID interrogator 52 to perform a scanning task in order to identify and/or categorize doll action figures, and associated pieces of clothing, and fashion accessories that are placed at close proximity to the mirror device. The scanning task includes the generation of a Radio Frequency ("RF") signal from the interrogator 52 through its antenna 50, which in turn propagates towards an object equipped with a passive RFID tag 80. Unlike an active tag that requires a battery to operate, a passive RFID tag obtains its operational power from the RF field emitted by the RFID interrogator or reader. A passive tag 80 operates by reflecting part of the incoming RF energy in a form that represents information encoded in the tag. In turn, the interrogator 52 receives the reflected message, and interprets the data contained in the message. The data is then fed to the microprocessor for processing. This data normally represents a unique identifier that is used by the microprocessor to locate corresponding descriptive information about the scanned item in its data base.

There are a variety of RFID techniques used in the art of radio frequency identification. For example, backscatter modulation could be used to reflect an incoming RF energy from the interrogator. Alternatively, Surface Acoustic Wave (SAW) technology could be used to produce a unique acoustic wave pulse train, which is directly converted into an encoded radio wave reply signal that is sent back to the interrogator. The specific RFID technology used to implement this concept is a matter of a design choice, and does not affect or limit the invention described herein. However, as would be appreciated by one skilled in the art, the RF power level generated by the RFID interrogator 52 should be carefully selected to ensure an optimized coverage for radio frequency identification. Such level should be strong enough to scan items within a coverage area that is consistent with the play pattern for the mirror device, but not too strong to scan items that are outside such coverage area.

As part of the play pattern for this interactive play device, the child is instructed to dress up a doll action figure 72 with matching clothing 74 and accessories 76, and to then place the action figure at close proximity to the mirror device 10, and within the coverage area of the RFID interrogator 52. The child is also instructed to first select a time period for the comparative evaluation feature, and then activate the "START" button 44 in order to initiate a play session. Upon the activation of the "START" button 44, the microprocessor, under the direction of the control program, activates the RFID interrogator 52 in order to verify that a doll action figure 72 has been placed within the scanning limits, or coverage area, of the mirror device, and to identify such action figure 72, and its associated clothing 74 and fashion accessories 76.

Upon the detection and identification of an action figure within the coverage area, the microprocessor executes a program segment that generates a verbal communication from the action figure 72 addressed to the mirror device 10. This communication requests the "magic" mirror to judge and/or evaluate the clothing combination worn by the action figure. Further, such verbal communication could be in a voice associated with the action figure play identity. The specific verbal request is a matter of design choice. However, a possible statement could, be in the form of a question from the doll action figure 72 addressed to the mirror device 10, "Magic mirror on the wall, who is the most fashionable of all?" In the preferred embodiment, such statement is generated through the speaker of the mirror device 33, and is intended to represent a statement by the doll action figure 72. As would be appreciated by one skilled in the art, each doll action figure could be equipped with a sound generating module, audio circuits, and a speaker in order to generate said verbal request. In such an implementation, and during a play session, the mirror device triggers the generation of the verbal request by transmitting a signal through a Radio Frequency, or an Infra Red communication link to activate the voice generating module located within the doll action figure.

Following the generation of the verbal request by the doll action figure 72, the microprocessor, under the direction of the control program, generates audio/visual effects that simulate "Magic" action by the mirror device.

Also, upon the detection of the clothing and fashion accessories worn by the action figure, the microprocessor executes a control program segment that evaluates and/or analyzes the combination of clothing and fashion accessories used by the player. Such evaluation is based on a number of parameters, including color coordination, style, matching pieces, fashion trend, consistency for an occasion, missing pieces, etc.

There are a number of design choices to implement the fashion evaluations or analyses. If the number of permutations for the various clothing items, and fashion accessories is manageable, then the analyses could be performed as part of the development and design process for the mirror device. In such a case, the data base stored in the memory of the mirror device will include a fashion analysis for each possible combination of clothing and fashion accessories.

Alternatively, the control program could include a plurality of algorithms that evaluate each combination based on a number of rules or principles. For example, a color coordination algorithm would be based on checking the color coordination between clothing items, between accessories, and between clothing items and accessories. A second algorithm will check for consistency of style between the various pieces of clothing and fashion accessories. A third algorithm will check for missing pieces from pre-determined sets, etc. Further, the control program calculates a composite fashion coordination score for each combination of clothing and accessories used by the player during a play session. This fashion coordination score is based on the various parameters used for fashion evaluation, and reflects how well the various pieces of clothing and accessories match together.

For the preferred embodiment, both the fashion analysis, and the fashion coordination score associated with each possible combination of clothing and accessories are stored in the data base for the mirror device. This data base resides in a data section of the control program, which in turn resides in the Read Only Memory (ROM) of the microprocessor. An additional data base could be provided in a removable flash memory, and would include descriptive information and data related to newly introduced doll action figures, and/or clothing and accessories. Accordingly, after the identification of the clothing combination used by the player, a control program segment searches the data base stored in memory to fetch a predetermined fashion evaluation that corresponds to the combination of clothing 74 and accessories 76 used by the child to dress up the doll action figure. In the preferred embodiment, this evaluation is in the form of a verbal communication that is played through the audio circuits 40 of the mirror device. Simultaneously with the generation of the verbal evaluation, the microprocessor activates a set of LED modules 28 within the mirror compartment to make the mirror surface 14 transparent, and to reveal a "Magical" figure behind the mirror so that it would appear to the child that said magical figure is providing the fashion evaluation.

As would be appreciated by one skilled in the art, other structures could be used to provide such fashion evaluation during a play session. For example, the surface of the mirror device 14 could incorporate an LCD screen to display the text for the fashion evaluation. Alternatively, an LCD could be placed behind the mirror surface, and would become visible upon the activation of a back light within the housing of the mirror device.

After the generation of the verbal evaluation, the microprocessor generates additional audio/visual effects as a preview to the comparative evaluation feature. A control program segment, also, determines which combination of action figure/clothing/fashion accessories has the highest score within the time period selected by the player. A verbal statement is then made by the mirror device, through its speaker 33, announcing the play name of the doll action figure that is "most fashionable of all." The announcement could also include a description of the clothing combination that won the highest score. Following the completion of the comparative evaluation feature, the microprocessor de-energizes the light source 28 located within the mirror device in order to restore the reflective characteristic of the mirror surface 14, and a new play session could then be initiated by the player.

It should be noted that the above description of the events that take place during a play session is provided for the purpose of describing the preferred embodiment, and is not intended to limit the invention herein. As would be appreciated by one skilled in the art, additional interactions could be programmed within a play session. For example, after the generation of the comparative evaluation, the action figure could inquire about its ranking with respect to the fashion score, and the mirror device will reply with the answer.

Figure 2:
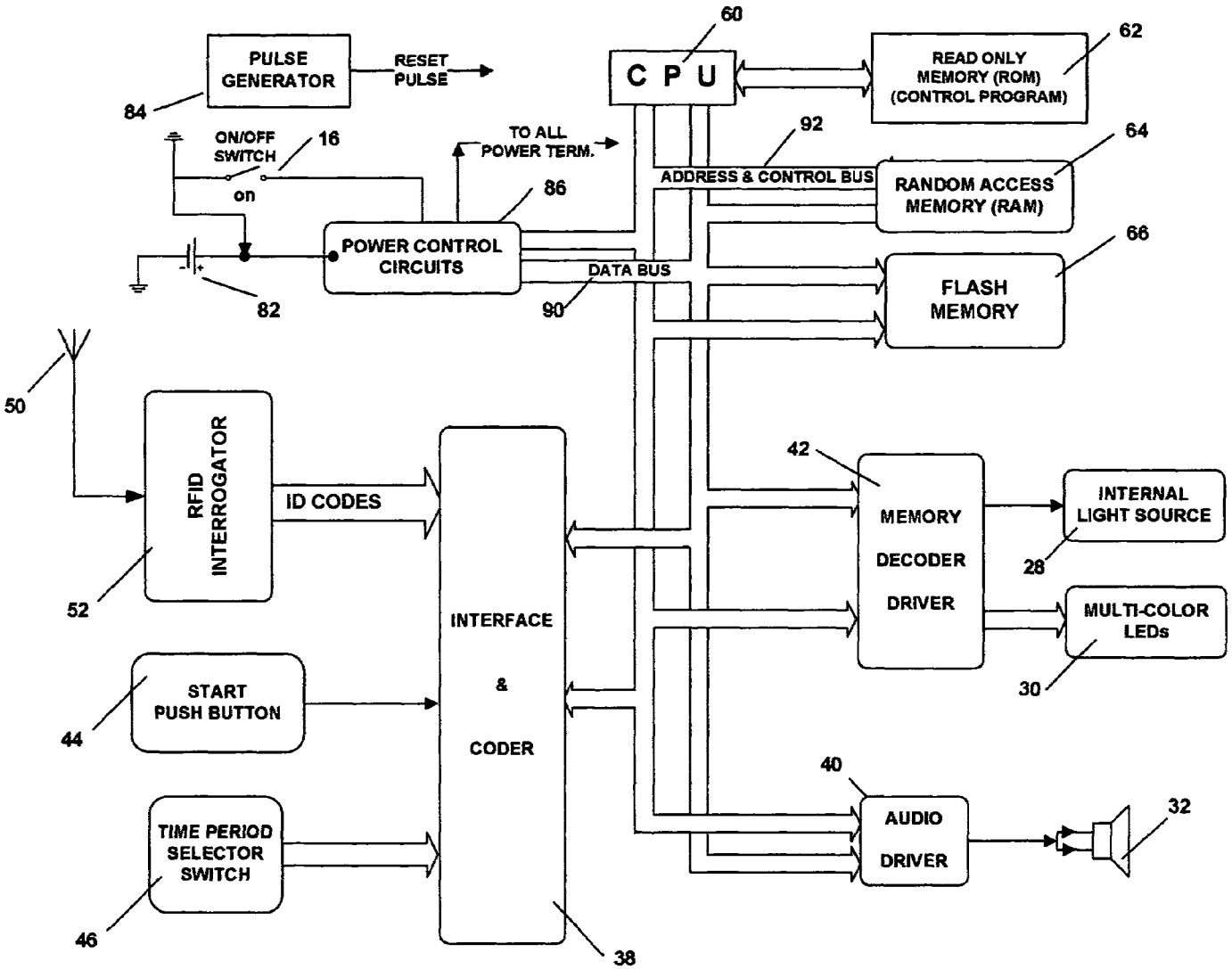
FIG. 2 is a block diagram of the microprocessor circuitry used to control the mirror device according to the invention.
Figure 3:
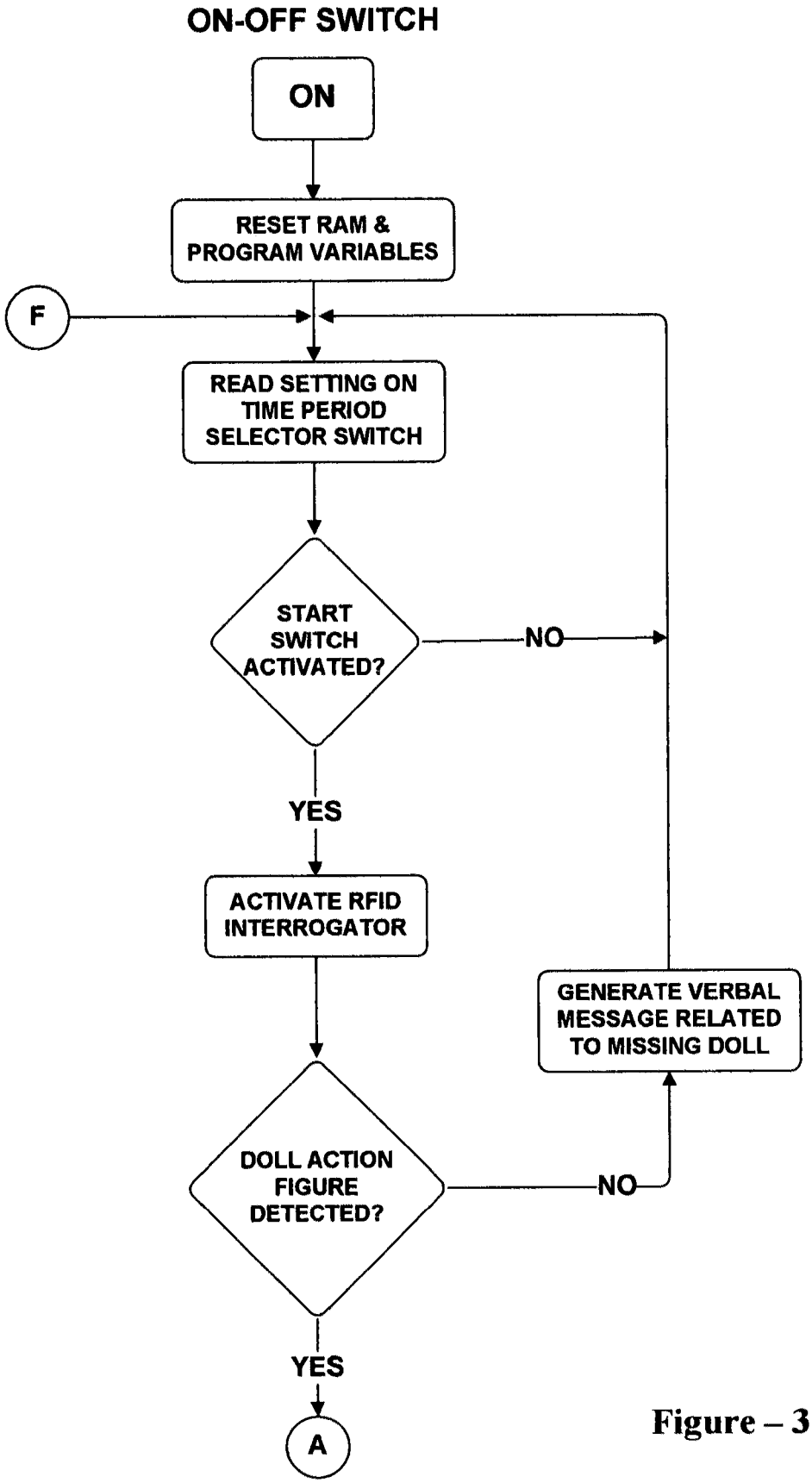
FIGS. 3-6 include a logical flow diagram illustrating the main program functions performed by the microprocessor controlling the mirror device according to the invention.
Figure 4:
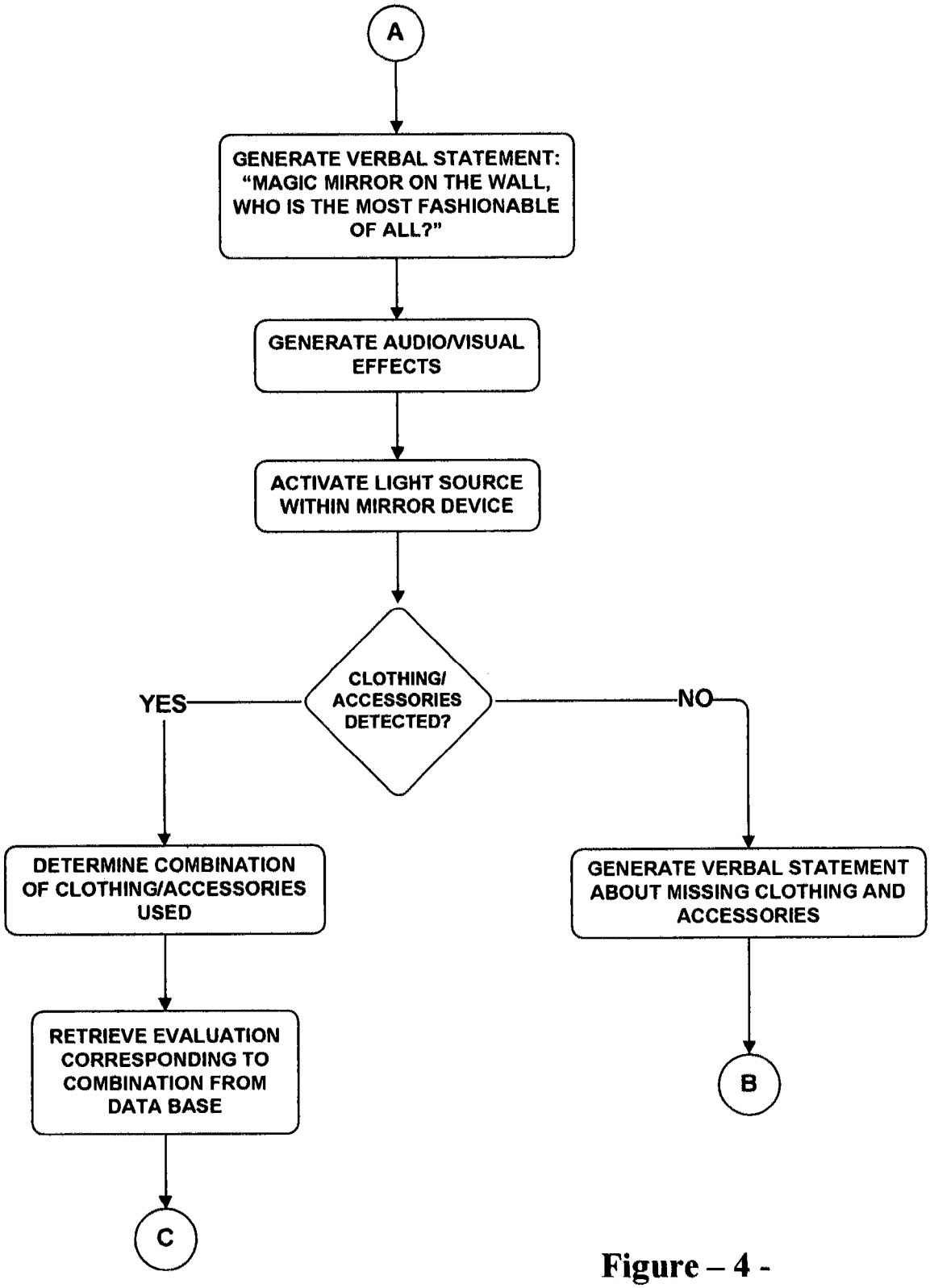
Figure 5:
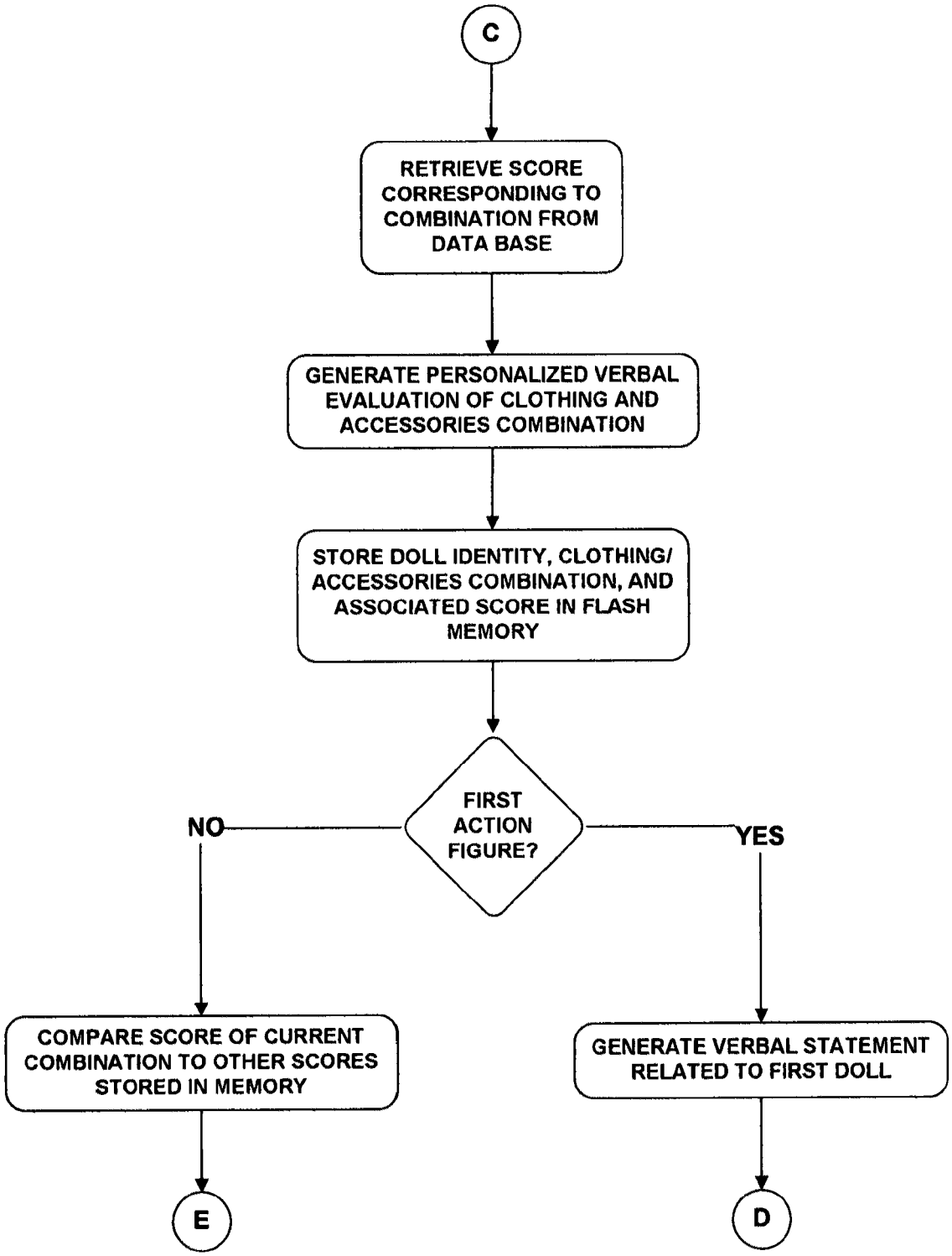
Figure 6:
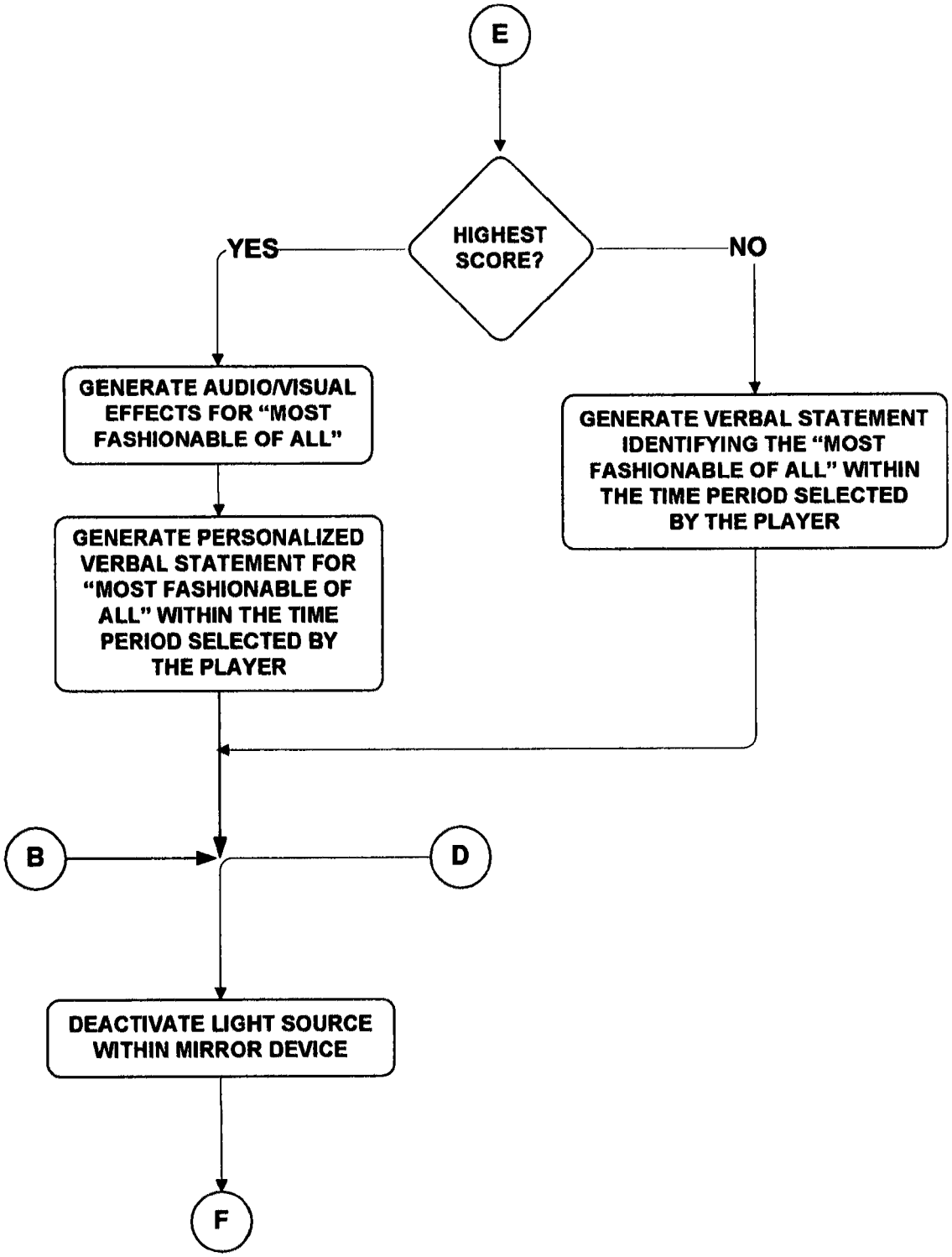

A block diagram of the control circuitry for the mirror device 10 is illustrated in FIG. 2. This control circuitry includes a central processing unit 60 having a read only memory (ROM) 62, where the control program resides, a removable FLASH memory 66, a random access memory (RAM) 64, an interface and coding device 38, a memory decoder driver 42, and audio interface and control circuits (audio driver) 40. The interface and coding device 38 is used as input interface between the RFID interrogator 52, the START push button 44, the time period selector switch 46, the RESET switch 48, and the central processing unit 60. In contrast, the memory decoder driver 42 is used as an output interface between the central processing unit 60 and the light source 28 within the mirror device, as well as the multi-color LEDs 30 that provide the visual effects. Similarly, the audio driver 40 is used as output interface between the central processing unit 60 and the loudspeaker 32. A common address and control bus 92, and a separate common data bus 90 are used to interconnect the central process unit 60 with the interface and coding device 38, the memory decoder driver 42, the audio driver 40, the read only memory (ROM) 62, the random access memory (RAM) 64, and the flash memory 66.

It should be noted that the above description of the control circuit of the device is provided as an example for illustration purposes only, and is not intended to limit the present invention. As would be obvious to those skilled in the art, a toy designer would most likely select a micro-controller with built-in audio driver to control the mirror device. Such micro-controller may include I/O ports that can be configured as input or output ports. The I/O ports of the micro-controller can be used to connect the various input and output devices directly to the micro-controller without the need for any interface and coding devices, or memory decoder drivers. Such micro-controllers are well known to those skilled in the art.

The central processing unit 60 controls the flow of all information throughout the entire mirror device under the direction of the control program. The control program resides in the read only memory (ROM) 62. A plurality of dry cell batteries 82 is positioned in the rectangular compartment behind the oval shaped mirror. These batteries 82 are fed to power control circuits 86, which is controlled by an ON/OFF switch 16. The power control circuits provide power to the central processing unit 60, the various LEDs 28 & 30, and the RFID reader 52.

With respect to the operation of this interactive play set, the logic steps utilized for the preferred embodiment are illustrated in flow diagram form in FIGS. 3 through 6, which interconnect with each other at the places shown in the various figures. Even though specific reference will not be made to this diagram in the following description of the operation of the device, periodic reference to this diagram may prove to be helpful to the reader hereof.

Referring again to FIG. 2, in order to operate the mirror play set, the player moves the off-on switch 16, located on the mirror device 10, from the "off" position to the "on" position which causes power to be supplied to all terminals of the mirror device 10, and which causes a pulse generator 84 to generate a reset pulse. The reset pulse is applied to the central processing unit 60 and causes the central processing unit 60 to clear any data remaining in the RAM 64 and in the audio driver 40 over the common data bus 90. This reset pulse does not affect the data stored in the flash memory 66.

The control program then reads the setting of the time period selector switch 46, and remains in a holding mode pending the activation of the START button 44. Upon the activation of said START button 44, the control program activates the RFID interrogator 52 in order to scan the coverage area for a doll action figure, and associated clothing and accessories. The control program then checks if an action figure has been detected. If no action figure was detected, the control program generates a verbal communication informing the player that there is no action figure within the coverage area. In such a case, the play session terminates, the control program goes into a holding mode awaiting the activation of the START button 44.

Alternatively, if the RFID interrogator detect a doll action figure within the coverage area, then the control program generates a verbal communication from the doll device addressed to the mirror device, and stating "Mirror - - - Mirror on the wall, who is the most fashionable of all?" The control program then generates audio/visual effects by activating the multi-color LEDs, and generating pre-determined sound signals through the speaker 32.

Following the generation of said audio/visual effects, the control program activates the light source within the mirror device to make the surface of the mirror device transparent, revealing an image of a magical figure within the mirror device. The control program also checks if clothing and accessories have been detected within the coverage area. If no clothing or accessories were detected, then the control program generates a verbal communication advising the player of the missing clothing and fashion items before terminating the play session. The control program then goes into a holding mode awaiting the activation of the START button.

Alternatively, if fashion and/or accessories are detected within the coverage area, then the control program retrieves the fashion evaluation corresponding to the combination of clothing and accessories from memory, and generates a verbal communication addressed to the doll action figure relaying to it the retrieved fashion evaluation. The control program, also, retrieves the corresponding fashion score from memory, and then store the identification information for the combination of clothing and accessories together with the associated fashion score in a play session file located in the flash memory.

The control program then determines if the doll action figure detected within the coverage area is the "first" action figure detected within the time period selected by the player. If the answer is "yes," then it is obvious that a comparative fashion evaluation cannot be performed. In such a case, the control program generates a verbal communication to the doll action figure stating that it was the first doll evaluated.

Alternatively, if the doll action figure was not the first detected in said time period, then the control program determines if the fashion score associated with the action figure is the highest score stored for the time period selected by the player. If said fashion score is not the highest score, then the control program generates a verbal communication to the doll action figure informing it that it is not the "most fashionable of all," and announcing the play name of the doll action figure with the highest score (i.e., "the most fashionable of all") within the time period selected by the player. The control program then deactivates the light source within the mirror device, thus restoring the reflective characteristics of the surface of the mirror device. Following such deactivation, the control program goes into a holding mode awaiting a new activation of the "START" button.

Alternatively, if the fashion score associated with the doll action figure is the highest score within the time period selected by the player, then the control program generates pre-determined audio/visual effects associated with "the most fashionable doll," and then generates a personalized verbal communication to the doll action figure announcing that it is "the most fashionable of all" within the time period selected by the player. The control program then deactivates the light source within the mirror device, thus restoring the reflective characteristics of the surface of the mirror device. Following such deactivation, the control program goes into a holding mode awaiting a new activation of the "START" button.

It should be noted that the fashion evaluation focus of the preferred embodiment could also be implemented by a play set in the form of a stage for fashion show competition. Such play set, also, employs a plurality of doll action figures, as well as a plurality of clothing & fashion accessories. The play set incorporates a microprocessor with a control program to control the various tasks performed by the play set. A single player could interact with the play set or, in the alternative a plurality of players could play a game of fashion competition using the doll action figures as game play pieces.

This stage device comes with six different doll action figures, and a plurality of clothing & fashion accessories. Similar to the mirror device, each action figure, and each accessory piece is tagged with a passive RFID tag. The stage for the fashion competition has two sections. The first section is designed as a walking path for the player to move a dressed up doll along the path, and incorporates the RFID interrogator and its antenna. The second section is in the form of a semi-circle structure that is attached at its center to the walking path. The semi-circle structure has six (6) positions to place the six doll action figures. Further, these positions are marked so that each doll action figure has a specific position on the stage.

The player is instructed to dress up one doll at a time, walk it on the pathway, and then place it at its designated position on the stage. Upon completing this first phase of play, the player is instructed to activate a "JUDGE" button for the play set to announce the winner of the fashion show. During said first phase of play, and as the player is walking an action figure on the pathway, the RFID interrogator scans the action figure to identify it, and to capture the digital information encoded on the various tags attached to the action figure's clothing and accessories. This information is then fed to the microprocessor, and based on the combination of clothing used a score is fetched from the data base stored in ROM. After all action figures are placed at their respective positions on the play set, and after the child activates the "JUDGE" button, the play set generates a plurality of audio/visual effects, and then announce the winners of the fashion show starting with the second runner up, the first runner up, and the "Fashion Queen," the winner of the fashion show.

Alternatively, a plurality of players could use the above described play set as a game of fashion competition. Each player selects a doll action figure as a game piece, and is instructed to dress up the selected doll with matching clothing and fashion accessories. Each player then walks an action figure on the stage, and places it at the designated position on the semi circle structure. Upon completing this first phase of game play, the "JUDGE" button is activated, and the control program compares the various fashion scores associated with the action figures to determine the winners of the fashion competition. The control program then generates a verbal communication to announce the second runner up, the first runner up, and the "Fashion Queen" that won the fashion competition.

It should be noted that the logical flow diagram shown in FIGS. 3 to 6 is only one example of how to implement the new general concept of a host toy interacting with a plurality of action figures. A person of ordinary skills in the art will appreciate that alternate programs may be utilized to implement this flow diagram. Obviously these programs will vary from one another in some degree. However, it is well within the skill of the computer programmer to provide particular programs for implementing each of the steps of the flow diagrams disclosed herein. It is also to be understood that the foregoing detailed description has been given for clearness of understanding only, and is intended to be exemplary of the invention while not limiting the invention to the exact embodiment shown.

Description of a First Alternate Embodiment

It should also be noted that the use of either the mirror device, or the stage device, disclosed herein is only for the purpose of describing the preferred embodiment, and is not intended to limit the invention hereto. A first alternate embodiment could be based on a motorized toy vehicle device as the primary toy. In such case, a plurality of play pieces in the form of stationary signs are used to provide an interactive play set. The motorized toy vehicle device employs a microprocessor to control the movement direction, speed, and steering mechanisms for the vehicle. The microprocessor also interfaces with a RFID interrogator that provides information to the microprocessor related to stationary signs detected within its coverage area. Each of these signs is equipped with a passive RFID tags that stores a unique code to identify the sign to the motorized vehicle device.

The child is instructed as part of the play pattern to place the stationary signs in the path of the motorized toy vehicle in order to "program" the movement and/or the action of the vehicle. As the toy vehicle approaches a stationary sign, the RFID interrogator transmits a modulated radio frequency request signal to energize the RFID tag located on the sign. In turn, the RFID tag uses the radio frequency energy received from the interrogator to reflect back to the interrogator the digital information encoded in the tag. The interrogator then receives a modulated radio frequency response from the stationary sign RFID tag. This response is demodulated, and the digital information encoded on the tag is fed to the microprocessor to identify the stationary sign to the vehicle.

Upon the identification of a sign, the microprocessor executes a control program segment that implements a movement, or an action command indicated on the sign. For example, the toy vehicle could be in the form of a car, and the stationary signs could be in the form of traffic signs. In such an implementation, if the traffic sign indicates a left turn, then the microprocessor executes a control program segment that causes the steering mechanism of the car to turn the car to the left. Similarly, if the traffic sign indicates a stop command, the microprocessor executes a program segment that causes the car to stop for a few seconds then proceed with its forward movement. In addition to left turn, right turn, U turn, and stop signs, the sign accessories could also include speed signs that instruct the car to slow down, or to increase speed. Other stationary signs could include signs to instruct the car to perform certain actions such as to turn its headlights "ON" and "OFF," or to activate its horn.

Figure 7:
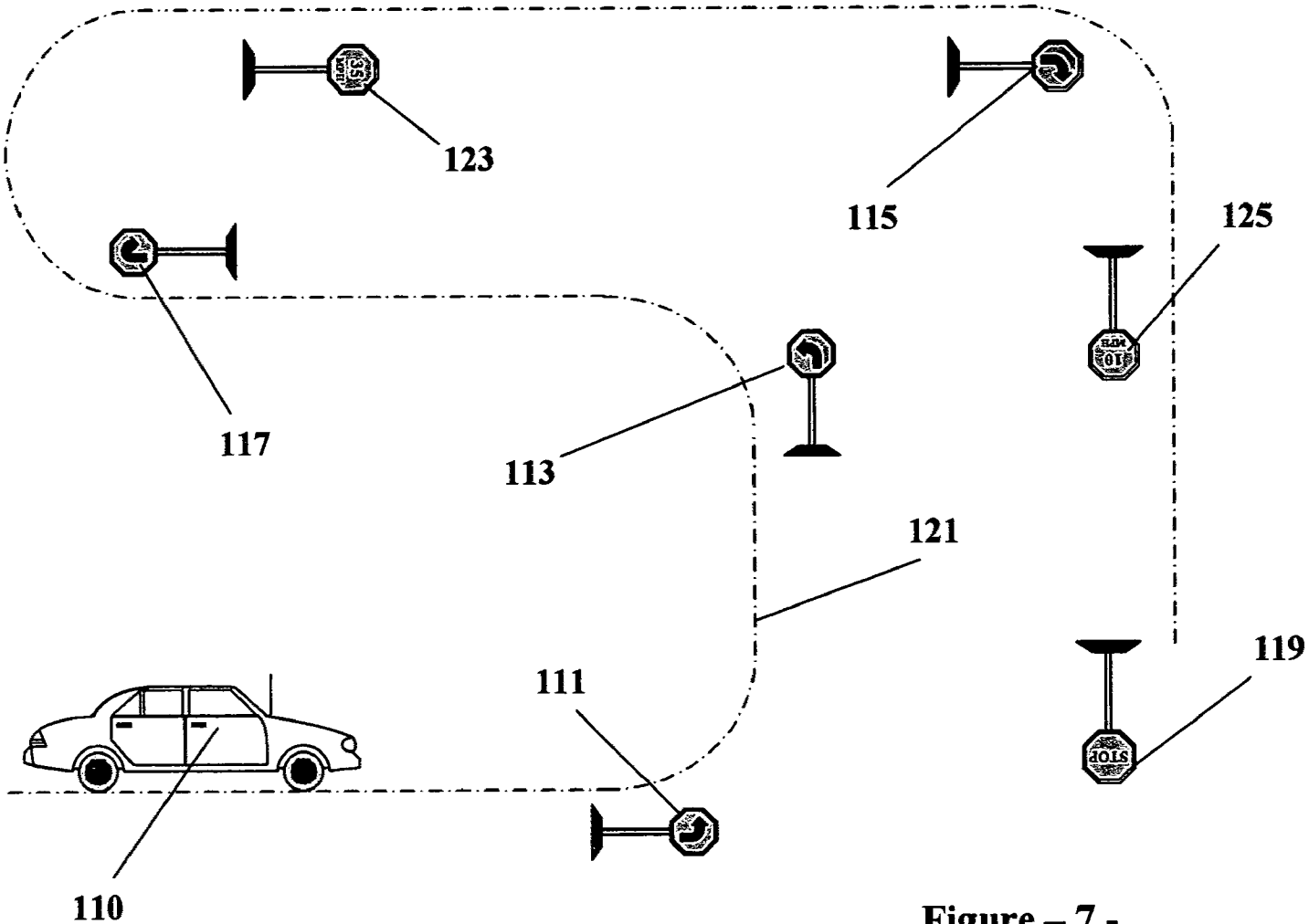
FIG. 7 is a view of the first alternate embodiment showing a motorized vehicle, and a plurality of traffic signs that are used to control the movement of the car according to the invention.

Referring now to the drawings where the illustrations are for the purpose of describing the first alternate embodiment of the invention, and are not intended to limit the invention hereto, FIG. 7 is an illustration of a primary toy in the form of a mechanized vehicle 110 in a play set that includes a plurality of traffic signs. The traffic signs are used by a player to control the movement of the vehicle 110, and to create a motion profile 121 for it. The traffic signs used in this illustration include two left turn signs 111 & 113, a right turn sign 115, a "U" turn sign 117, and a stop sign 119. There are also two speed control signs 35 MPH 123 & 10 MPH 125 used in this illustration to control the speed of the mechanized vehicle 110.

A second example to implement this motorized vehicle could be in the form of a military vehicle such as a tank. In such an implementation, the stationary signs could relay battle commands to the vehicle as well as traffic instructions. The battle commands could include rotating the turret of the tank, firing a cannon, etc. A third example to implement this motorized vehicle could be in the form of a rescue vehicle such as a fire truck. In such an implementation, the stationary signs could relay to the vehicle special commands in addition to the traffic instructions. These special commands could include rotating the ladder mechanism, extending the ladder, activating a siren, etc.

It should be noted that a plurality of signs could be placed close together in a coverage area. In such a case, the microprocessor is programmed to execute the instructions from said plurality of signs in a pre-determined order. For example, for a fire truck implementation, a player could place three different signs in close proximity to each other. The first sign instructs the fire truck to stop, the second sign instructs the fire truck to rotate its ladder, and the third sign instructs the fire truck to extend its ladder. In turn, upon detecting these signs in its coverage area, the microprocessor that controls the fire truck will execute the three instructions in the order of stopping the truck, rotating the ladder, then extending the ladder.

As would be appreciated by a person skilled in the art, the concept described herein could also be used with a remote control motorized vehicle. In such a case, the player uses the remote control apparatus to control the movement direction, speed, and steering of the motorized vehicle until a stationary sign is detected within the coverage area of the vehicle. Upon such detection, the microprocessor executes the instruction associated with the detected sign, independent of the movement commands received from the remote control apparatus. Then after the execution of said instruction, the control for the vehicle is returned to the player.

Further, it should be noted that some of the stationary signs could simply provide location information to the vehicle. Such location information is useful in a broader play set that employs a plurality of vehicles. The location information could be used by the vehicle to determine its own location relative to the broader play set, or could be transmitted to a centralized play piece in said broader play set, which generates interactions that are dependent on vehicle location within the play set.

During a play session, the motorized vehicle device is programmed to memorize the motion profile and actions corresponding to the configuration of stationary signs used by the player during the play session. A stored motion profile could be retrieved, and played back by the player during a subsequent play session.

A fourth example of this first alternate embodiment is implemented by a play set that includes a remote controlled motorized vehicle in the form of a taxi car with a RFID reader, a plurality of action figures depicting "passengers," a plurality of traffic signs, and a plurality of structures. These structures include houses, office buildings, a train station, a hospital, a school, etc. Further, the structures represent destinations for the passengers to go to. Each action figure, traffic sign, and building is equipped with a passive RFID tag. In a first mode of play, and upon recognizing a "passenger" action figure located within the coverage area of the RFID reader, the motorized taxi device is programmed to stop. The player is instructed to place the passenger action figure inside the taxi car device, and then create, or program, a motion profile associated with said passenger ("a passenger trip") using the remote control apparatus and/or traffic signs. The player is also instructed to terminate the motion profile at a building.

As such, a motion profile, or a passenger trip, incorporates a specific destination represented by the RFID identity of the building selected by the player for this particular passenger.

In a second mode of play, upon encountering the same passenger, and upon the placement of the passenger inside the cab, the taxi device is programmed to retrieve the motion profile associated with the passenger. Under this mode of play, the microprocessor that controls the taxi device executes said motion profile, and automatically takes the passenger action figure to its destination following the route established by the player during the first mode of play. The microprocessor generates a sequence of speed and steering commands based on the retrieved motion profile. Obviously, the player is instructed to place both the passenger and its destination structure at the same locations used in the first mode of play.

However, in a variation of this implementation a passenger trip could simply two RFID identifications, the passenger identification, and the destination identification. In such a case, the play set includes predefined routes over a network of interconnected tracks that depict streets. During the first mode of play, the player is instructed to place a passenger action figure and its destination at random locations on the play set. Using the remote control apparatus, the player program a "passenger trip" for the action figure by first stopping the taxi device at the passenger location, and then operating the taxi device via the remote control switches using any route on said network of tracks leading to the selected destination. In a second mode of play, the player is instructed to place the passenger action figure and its destination at different locations. During said second mode of play, the microprocessor is programmed to stop the cab device upon encountering the passenger action figure. Then upon the placement of the passenger inside the cab, the microprocessor is programmed to "drive" the cab device through the network of tracks until it encounter the destination building. It should be noted that the above described play set could include a plurality of taxi devices that operate simultaneously on said network of tracks.

Figure 8:
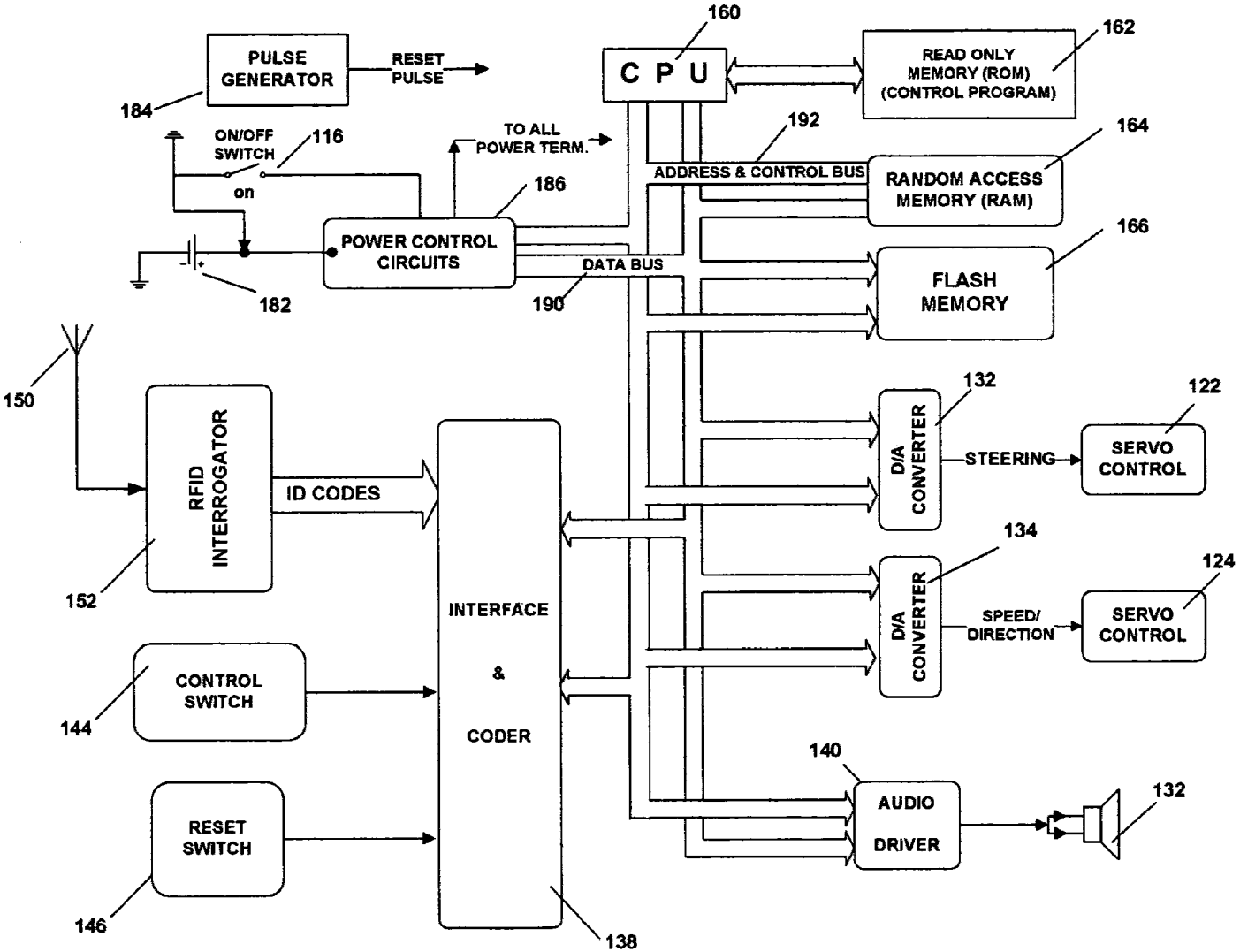
FIG. 8 is a block diagram of the microprocessor circuitry used to control the motorized vehicle according to the first alternate embodiment of the invention.

A block diagram of the control circuitry for the mechanized vehicle 110 is illustrated in FIG. 8. This control circuitry includes a central processing unit 160 having a read only memory (ROM) 162, where the control program resides, a removable FLASH memory 166, a random access memory (RAM) 164, an interface and coding device 138, a memory decoder driver 142, and audio interface and control circuits (audio driver) 140. The interface and coding device 138 is used as input interface between the RFID interrogator 152, the control switch 144, the "RESET" switch 148, and the central processing unit 160. Alternatively, the audio driver 140 is used as output interface between the central processing unit 160 and the loudspeaker 132. Similarly, digital to analog converters 132 & 134 are used as output interface units between the central processing unit 160, and the servo mechanisms 122 & 124 that control the steering and the electric motor for the vehicle. A common address and control bus 192, and a separate common data bus 190 are used to interconnect the central process unit 160 with the interface and coding device 138, the audio driver 140, the digital to analog converters 132 & 134, the read only memory (ROM) 162, the random access memory (RAM) 164, and the flash memory 166.

It should be noted that the above description of the control circuit of the device is provided as an example for illustration purposes only, and is not intended to limit the present invention. As would be obvious to those skilled in the art, a toy designer would most likely select a micro-controller with built-in audio driver to control the mechanized vehicle. Such micro-controller may include I/O ports that can be configured as input or output ports. The I/O ports of the micro-controller can be used to connect the various input and output devices directly to the micro-controller without the need for any interface and coding devices, or memory decoder drivers. Such micro-controllers are well known to those skilled in the art.

The central processing unit 160 controls the flow of all information throughout the entire mechanized vehicle under the direction of the control program. The control program resides in the read only memory (ROM) 162. A plurality of dry cell batteries 182 is positioned in a compartment within the vehicle device. These batteries 182 are fed to power control circuits 186, which is controlled by an ON/OFF switch 116. The power control circuits provide power to the central processing unit 160, the digital to analog converters 132 & 134, the servo mechanisms 122 & 124, the electric motor, and the RFID reader 152.

Figure 9:
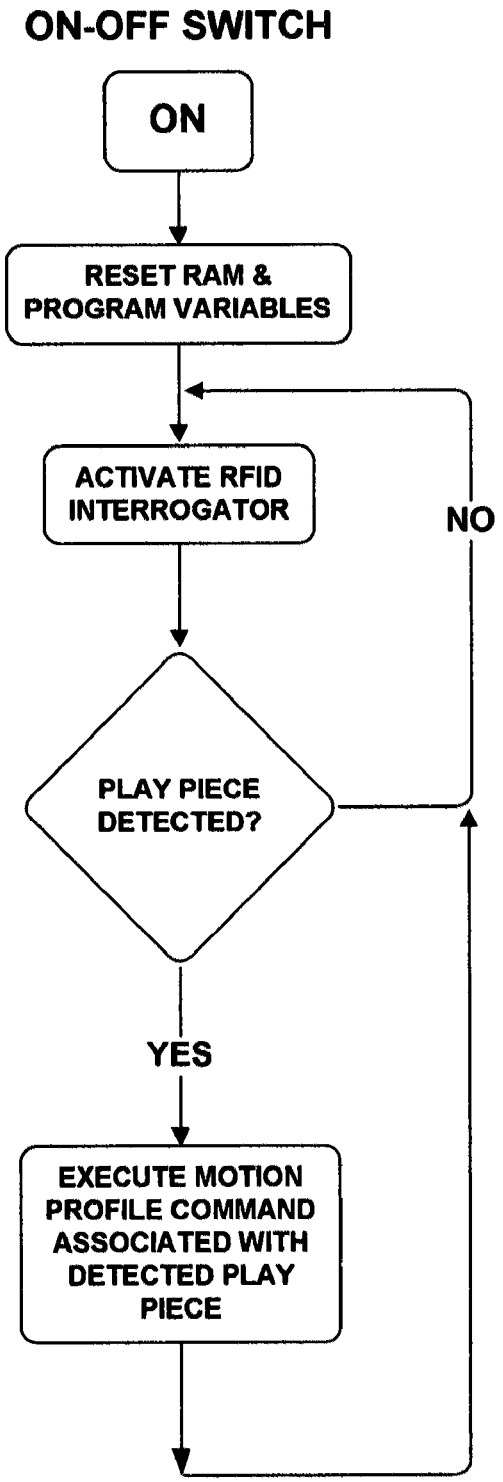
FIG. 9 includes a generic logical flow diagram illustrating the main program functions performed by the microprocessor controlling a motorized vehicle device according to the first alternate embodiment of the invention.

With respect to the operation of this mechanized vehicle device, there are two control programs described in this first alternate embodiment. The first control program is indicated in FIG. 9, and includes the logic steps utilized for a basic implementation of the vehicle device. The control program simply receives the identity of a detected play piece from the RFID interrogator, and executes a motion profile command associated with said play piece. The play piece could be in the form of a traffic sign such as a stop sign, left or right turn sign, or the like. The play piece could also be in the form of an action figure, such as a police officer that causes the vehicle to stop. Other play pieces could include a remote control police car that is controlled by the child, and which employs sirens and flashing lights. The child is instructed to operate the remote control police car behind the motorized vehicle, and activate the siren and flashing lights. Upon such activation, an internal active RFID tag is energized, and is then detected by the motorized vehicle, which in turn causes the vehicle to stop.

Figure 10:
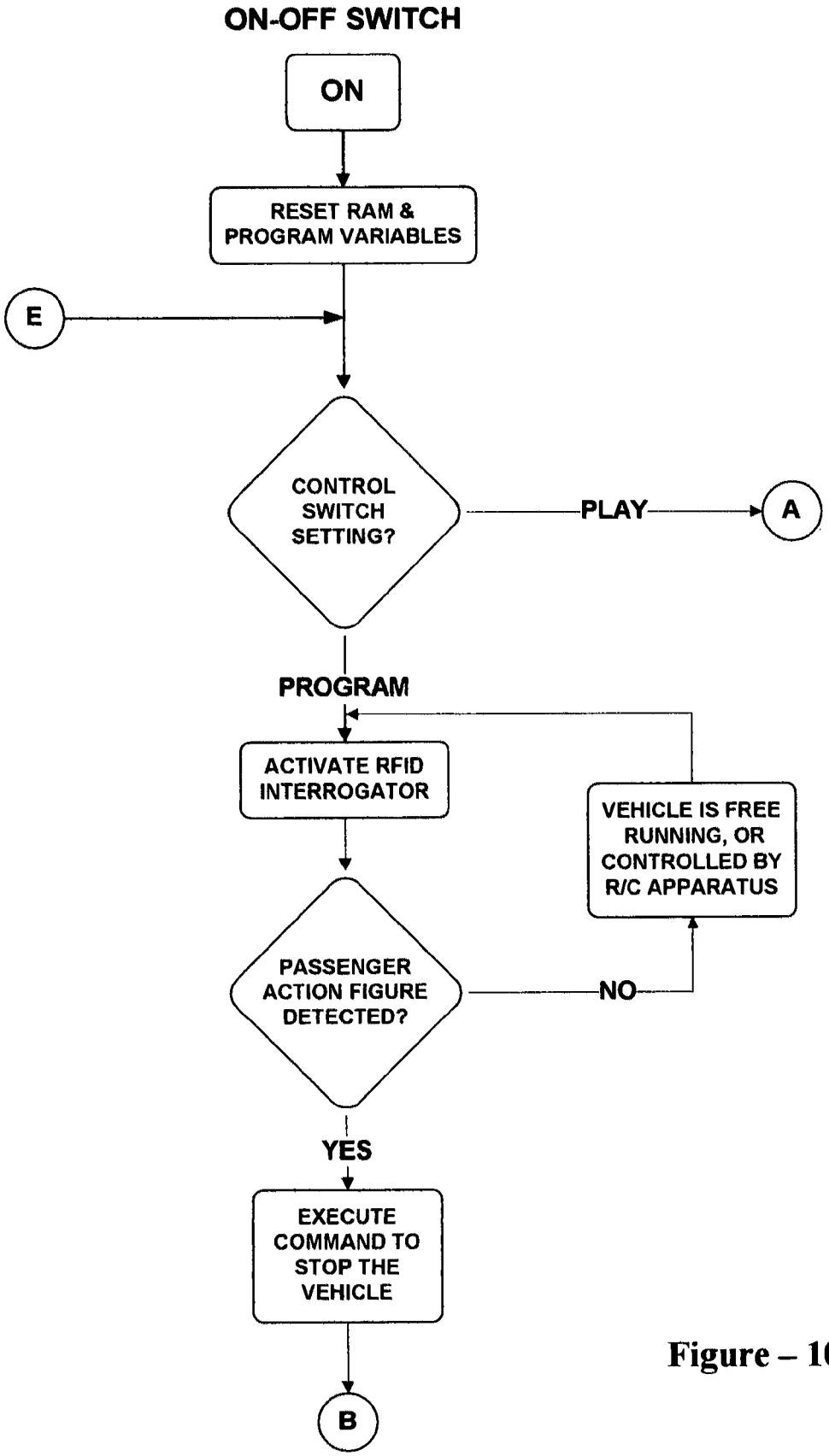
FIGS. 10-12 include a logical flow diagram illustrating the main program functions performed by the microprocessor controlling a programmable motorized vehicle device according to the first alternate embodiment of the invention.
Figure 11:
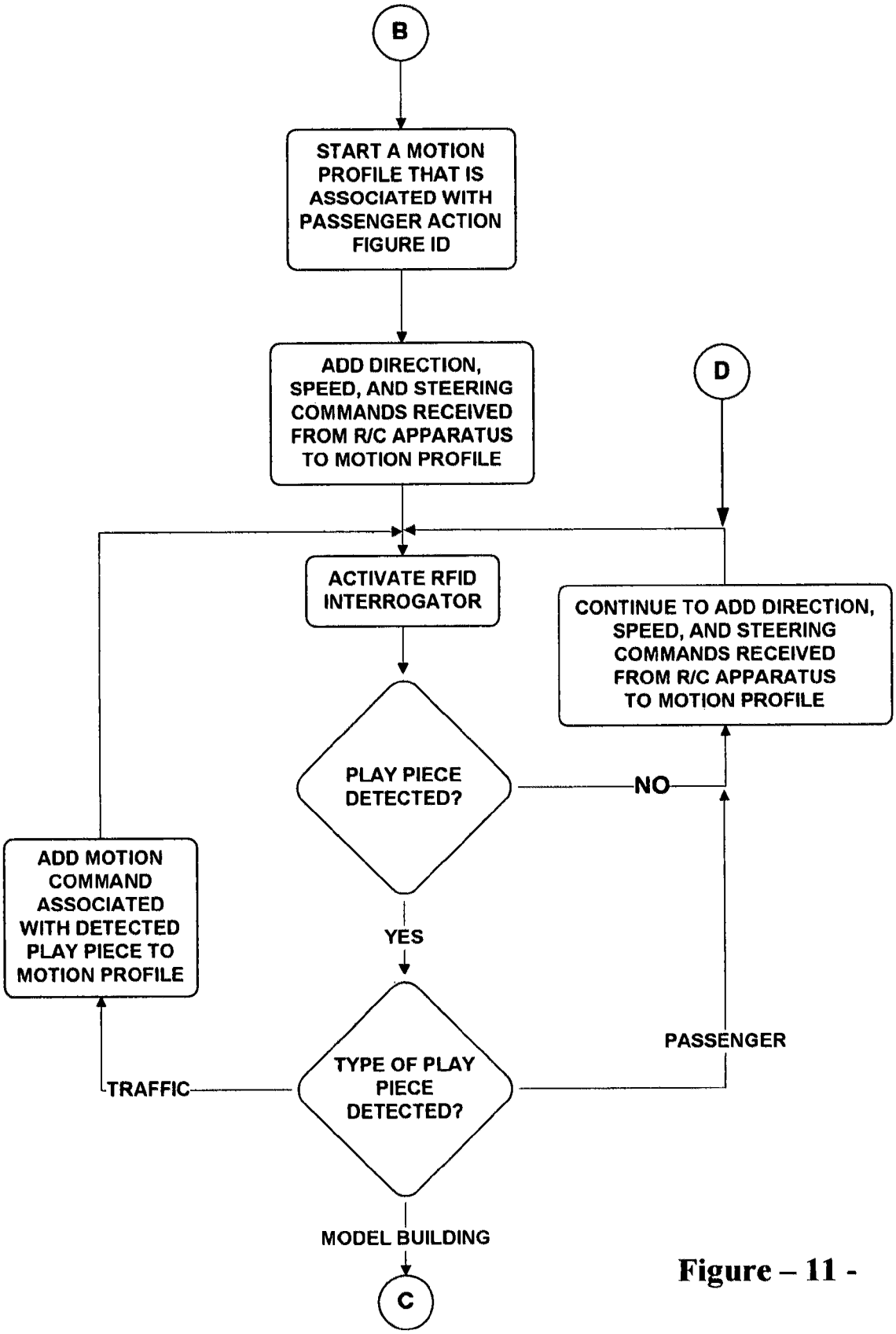
Figure 12:
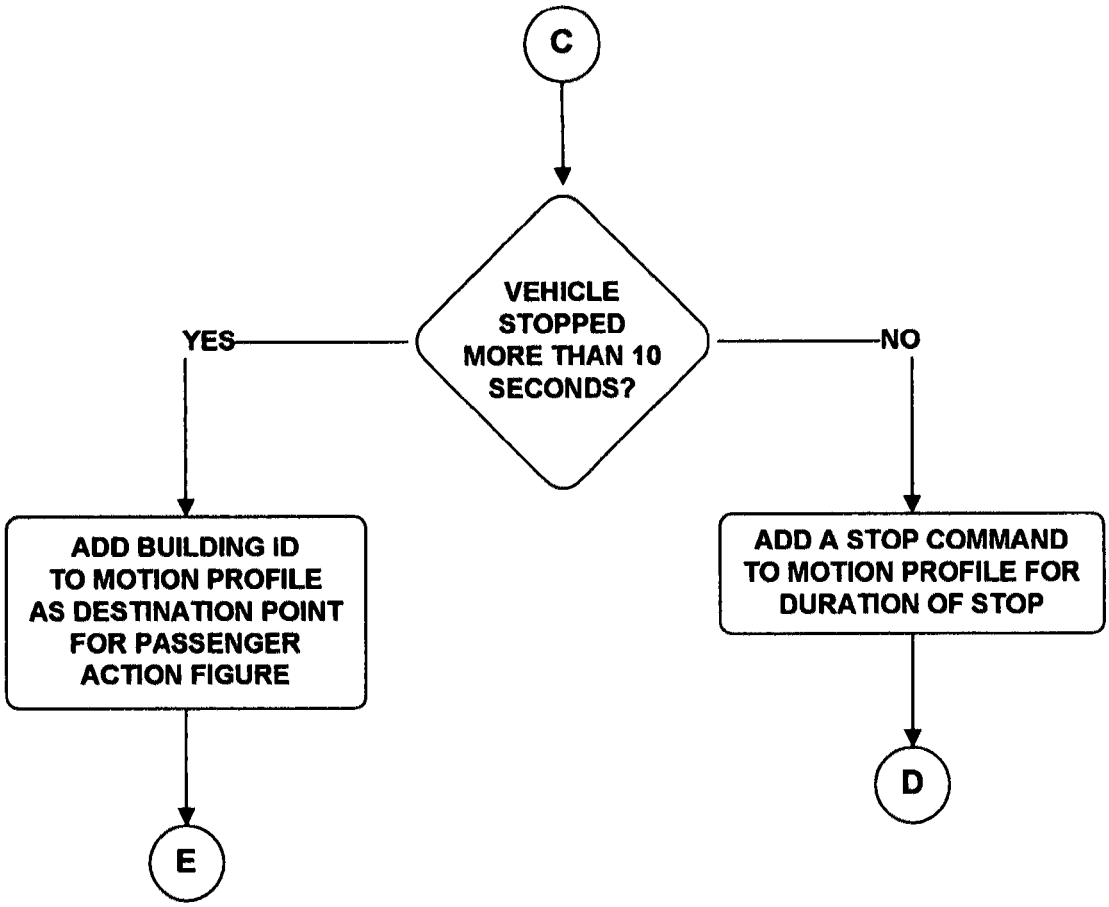

The second control program is illustrated in FIGS. 10 through 12, which interconnect with each other at the places shown in the various figures. This control program includes the logical steps for a mechanized vehicle in the form of a taxi cab according the first alternate embodiment, wherein a player can program, and store within the memory of the vehicle device, a trip associated with an action figure that depicts a passenger. Even though specific reference will not be made to this diagram in the following description of the operation of the vehicle device, periodic reference to this diagram may prove to be helpful to the reader hereof.

Referring again to FIG. 8, in order to operate the vehicle device, the player moves the off-on switch 116, located on the vehicle device 110, from the "off" position to the "on" position which causes power to be supplied to all terminals of the vehicle device 110, and which causes a pulse generator 184 to generate a reset pulse. The reset pulse is applied to the central processing unit 160 and causes the central processing unit 160 to clear any data remaining in the RAM 164 and in the audio driver 140 over the common data bus 190. This reset pulse does not affect the data stored in the flash memory 166, including data related to programmed trips or motion profiles.

The control program steps indicated in FIGS. 10 through 12 are then executed to provide two main modes of operation. Under the first mode, identified as a program mode, the player can program a trip for a specific action figure. In order to activate this first mode of operation, the player is instructed to operate the control switch 144 to the "program" position. The player is also instructed to place a passenger action figure within a play area defined by the play set, and to then operate the vehicle using a remote control apparatus so that the vehicle passes by the location of the action figure. Further, the player is instructed to place play pieces in the form of buildings within the play area to provide a plurality of possible destinations for the passenger. Upon an RFID detection of the passenger action figure, the control program executes a program segment that causes the vehicle to stop. The control program also initiates a motion profile associated with the action figure. The player is instructed to place the action figure into the vehicle, and operate the vehicle using the remote control apparatus and/or traffic signs to bring the passenger to a destination of his or her choosing. The control program then stores the sequence of speed and steering commands used by the player to bring the passenger to a destination. The control program also stores the identity of the destination building selected by the player during the play session as part of the trip information data.

To activate the second mode of operation, identified as the "play" mode, the player is instructed to place the control switch to the "play" position. The player is also instructed to place a passenger, for which a trip was programmed, together with its associated destination building at the same locations used by the player during the programming of the trip. Further, the player is instructed to operate the vehicle so that it passes by the location of the action figure. Upon detecting the passenger, the control program causes the vehicle to stop, and retrieves the motion profile associated with the passenger action figure from memory. Then upon placing the action figure in the vehicle, the control program executes said motion profile to bring the passenger to its destination without receiving any further commands from the player. It should be noted that the trip data associated with an action figure could be limited to the action figure identification, and the destination identification. In such a case, a pre-programmed motion profile could be used to scan the play area, and to locate both the passenger, and its destination.

It should, also, be noted that the specific steps included in FIGS. 10 through 12 are provided only as an example to demonstrate the first alternate embodiment. A person of ordinary skills in the art will appreciate that alternate flow charts could be utilized to implement this motorized vehicle device. Obviously these flow charts will vary from one another in some degree. However, it is well within the skill of a toy designer to provide particular flow charts for implementing various interactions for the motorized vehicle using the various play pieces of the play set. It is to be understood that such particular flow charts are within the scope and intent of the current invention. It is also to be understood that the foregoing detailed description, and the specific steps included in FIGS. 10 through 12 have been given for clearness of understanding only, and are intended to be exemplary of the invention while not limiting the invention to the exact steps shown.

Description of a Second Alternate Embodiment

Further, the objectives of the invention could be achieved by a second alternate embodiment that includes an interactive toy pet, and a plurality of play pieces. The interactive toy pet could be in the form of an animal, a fictitious character, a robot, a television or movie cartoon character, or the like. In addition, the toy pet could be mechanized, or could interact with the player verbally. The toy pet device includes a microprocessor that interfaces with a RFID interrogator with associated antenna. Each of said plurality of play pieces is equipped with a passive RFID tag that stores a unique identification code to identify the play piece to the pet toy device. Further, upon the identification of a particular play piece, the toy pet is programmed to perform an action, or a plurality of actions.

For example, the toy pet could be in the form of a mechanized toy dog. In such a case, the toy dog could perform a plurality of acts or basic "tricks" that include generating a plurality of barking sounds, generating a growling sound, wigging its tail, moving its ears, moving its mouth in a simulated chewing action, blinking its eyes, and the like. A plurality of play pieces in the form of cue cards with images are used to instruct the dog to perform one of said plurality of basic tricks, and to also teach the dog to perform more sophisticated tricks. A cue card could be static, or could be of the animated type that employs a tab that causes the image on the card to display an animated feature. The dog device includes a microprocessor, and a RFID interrogator & its antenna. Each cue card has a passive RFID tag with a unique identification code. An animated cue card, also, includes a shield for the RFID tag that is activated by its tab.

Figure 13:
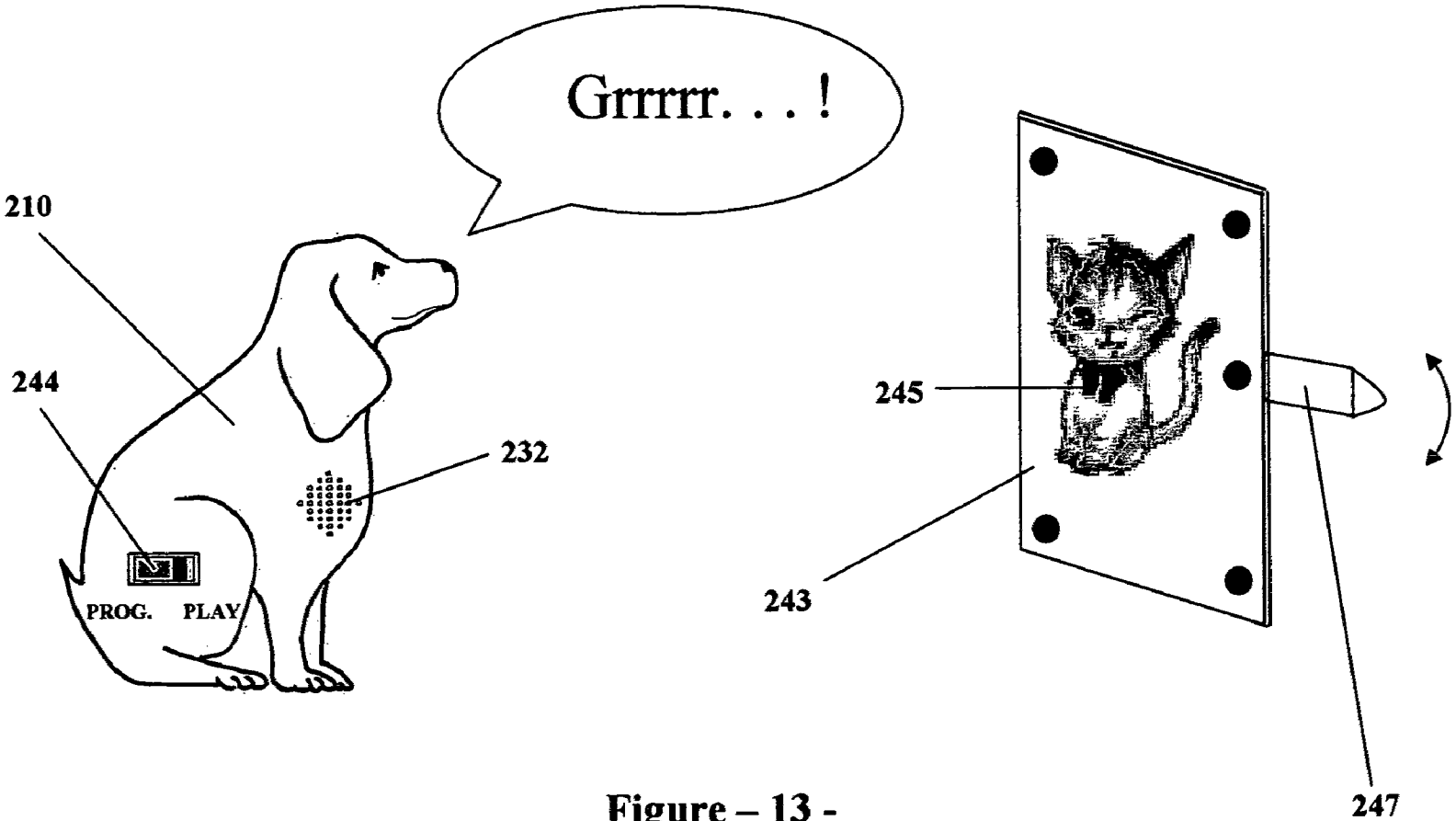
FIG. 13 is a view of the second alternate embodiment showing an interactive toy pet device in the form of a dog that is activated by an animated cue card according to the invention.

Referring now to the drawings where the illustrations are for the purpose of describing the second alternate embodiment of the invention, and are not intended to limit the invention hereto, FIG. 13 is an illustration of a primary toy in the form of an interactive dog device 210 in a play set that includes a plurality of cue cards. The cue cards are used by a player to control the actions of the dog device 210. FIG. 13 shows an example of an animated cue card 243 with an image of a cat 245. The cue card has a tab 247 that could be rotated by a player to activate an animated feature of said image. The cat blinks its eyes, and extends its tongue when the tab 247 is activated. The internal animation mechanism also moves a shield to cover and uncover a passive RFID tag, which in turn causes the RFID tag to receive the RF energy transmitted by the RFID interrogator. Accordingly, the activation of the animation mechanism acts as a trigger to enable the detection of the RFID passive tag, and the transmission of information stored in the tag.

It should be noted that the use of a shield to enable, and disable the detection of the RFID tag is provided only for the purpose of describing this second alternate embodiment. As would be appreciated by a person skilled in the art, other means to enable the RFID communication could be used. For example, the passive RFID tag could be disabled by placing the use of an electrical short that is activated by a simple push button. Alternatively, a designer may elect to use an active RFID tag to provide similar effects. However, active tags have the disadvantage of requiring electrical energy to operate.

There are a number of play modes for this interactive dog device. In a basic mode of play, where the dog performs simple tricks, the child is instructed to place a cue card in front of the dog device so that the dog can "read it," and perform the trick associated with the cue card. As the child brings the cue card closer to the dog device, the RFID interrogator transmits a modulated radio frequency request signal to energize the RFID tag located on the cue card. In turn, the RFID tag uses the radio frequency energy received from the interrogator to reflect back to the interrogator the digital information encoded in the tag. The interrogator then receives a modulated radio frequency response from the cue card RFID tag. This response is demodulated, and the digital information encoded on the tag is fed to the microprocessor to identify the specific cue card used by the child. This information then triggers the required action by the dog device. For example, if the cue card instructs the dog to bark, then a microprocessor within the dog device executes a program segment that generates a barking sound.

A more advanced mode of operation is related to more sophisticated actions, tricks or interactions, and requires the player to "program" the interactive dog device using the basic acts or tricks as building blocks. A plurality of "programmable" cue cards, each with a passive RFID tag that stores a unique identifier, is provided as part of the interactive dog play set. Each of these programmable cards has a symbol, image, drawing or a picture. The player is instructed to program a sequence of acts, using the basic tricks as building blocks, for each programmable cue card. For example, a first programmable card could have an image of food or a treat for the dog. The player can then program the sequence of a friendly barking sound, a chewing action, and a wigging tail action as an advanced or sophisticated trick that corresponds to the programmable cue card of food or a treat. A second example is the animated and programmable cue card 243 that includes the image of a cat 245. In such a case, the player could program the sequence of a growling sound, a movement of the ears, and a loud barking sound as an advanced or sophisticated trick that corresponds to said animated and programmable cue card of a cat.

It should be noted that because children have different imaginations, it is most likely that individual players will program the various cue cards in a different manner. As such, this interactive pet toy play set is customized to the player. Similar to a LEGO building block set, or a construction set, children can use the basic acts or tricks as building blocks for creating more sophisticated or advanced interactions for an interactive toy pet. To program an advanced interaction, the player is instructed to first place a "MODE" switch 244 located on the pet toy to the program position. The player is then required to flash the programmable cue card in front of the toy pet in order to associate it with the advanced interaction being programmed. If the programmable cue card is of the animated type, then the player is instructed to operate the animation tab to uncover the RFID tag, and identify the card to the toy pet device. Next, the child is instructed to "construct" or develop the advanced interaction using a sequence of basic cue cards as building blocks. The last step in this programming process requires the child to flash the programmable card, or activate the mechanical tab in the case of an animated cue card, for a second time to indicate to the pet device that the programming is completed. To activate an advanced trick or interaction, the player simply moves the "MODE" switch 244 to the play position, then flashes a programmable cue card in front of the pet device. In turn, upon receiving the identification code for a programmable cue card from the RFID interrogator, the microprocessor executes the sequence of actions that were programmed by the player during a previous play session.

It should also be noted that the use of cue cards is disclosed for the purpose of describing this second alternate embodiment. As would be appreciated by a person skilled in the art, various types of playing pieces could be used with the above described interactive pet device. For example, in lieu of a cue card with a picture of a cat, the play set could include an action figure in the form or shape of a cat. This cat action figure would include a passive RFID tag to identify it to the dog device. Similarly, other action figures depicting other animals, as well as play pieces in the form of dog treats, or the like could be used.

Figure 14:
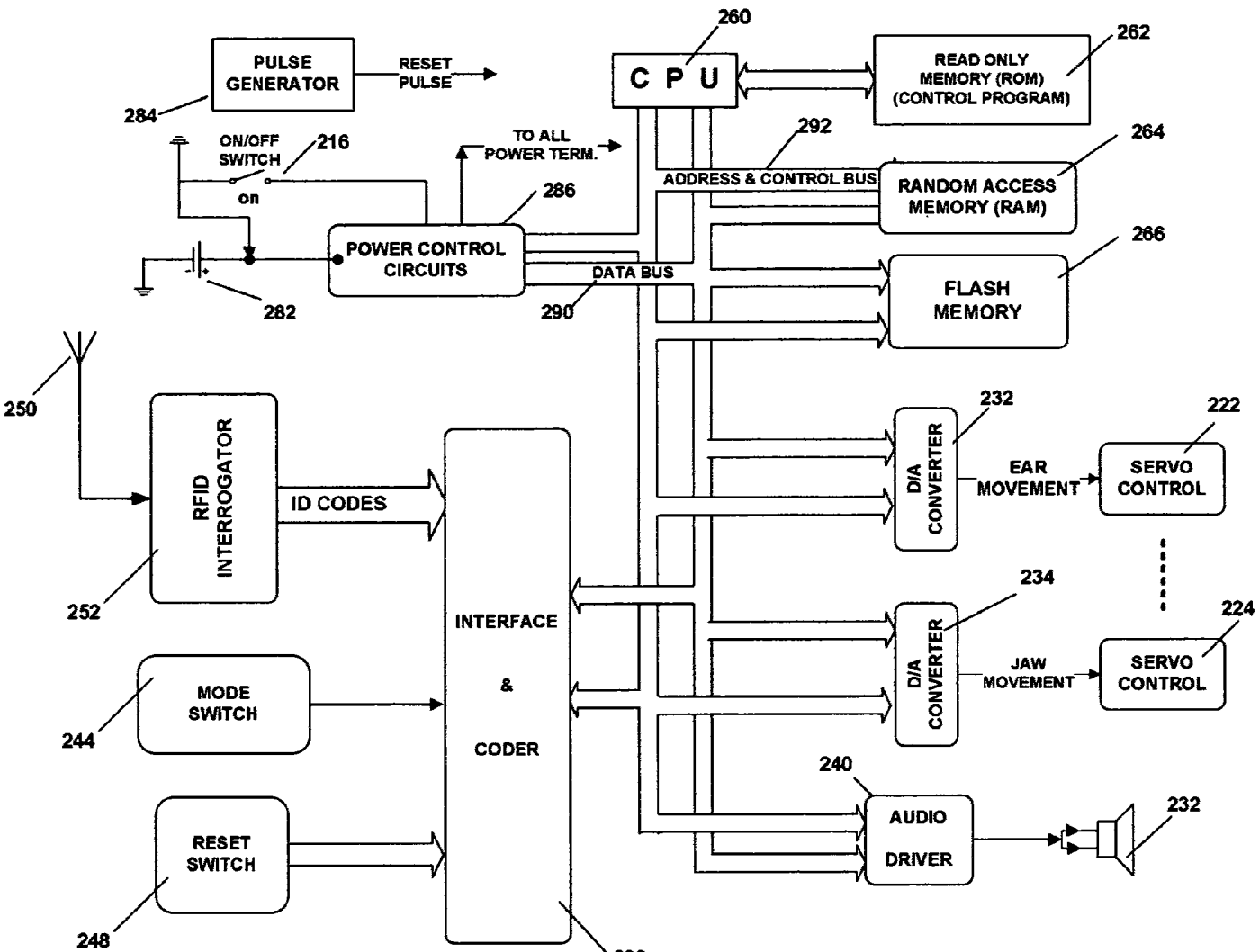
FIG. 14 is a block diagram of the microprocessor circuitry used to control the toy pet device according to the second alternate embodiment of the invention.

A block diagram of the control circuitry for the interactive toy pet device 210 is illustrated in FIG. 14. This control circuitry includes a central processing unit 260 having a read only memory (ROM) 262, where the control program resides, a removable FLASH memory 266, a random access memory (RAM) 264, an interface and coding device 238, a memory decoder driver 242, and audio interface and control circuits (audio driver) 240. The interface and coding device 238 is used as input interface between the RFID interrogator 252, the "MODE" switch 244, the "RESET" switch 248, and the central processing unit 260. Alternatively, a plurality of digital to analog converters 232 to 234 together with a plurality of servo control mechanisms 222 to 224 are used to provide various mechanized features for the toy pet device, such as ear movement, jaw movement, and the like. Similarly, the audio driver 240 is used as output interface between the central processing unit 260 and the loudspeaker 232. A common address and control bus 292, and a separate common data bus 290 are used to interconnect the central process unit 260 with the interface and coding device 238, the audio driver 240, the digital to analog converters 232 & 234, the read only memory (ROM) 262, the random access memory (RAM) 264, and the flash memory 266.

It should be noted that the above description of the control circuit of the device is provided as an example for illustration purposes only, and is not intended to limit the present invention. As would be obvious to those skilled in the art, a toy designer would most likely select a micro-controller with built-in audio driver to control the interactive toy pet device. Such micro-controller may include I/O ports that can be configured as input or output ports. The I/O ports of the micro-controller can be used to connect the various input and output devices directly to the micro-controller without the need for any interface and coding devices, or memory decoder drivers. Such micro-controllers are well known to those skilled in the art.

The central processing unit 260 controls the flow of all information throughout the entire interactive toy pet device under the direction of the control program. The control program resides in the read only memory (ROM) 262. A plurality of dry cell batteries 282 is positioned in a compartment within the toy pet device. These batteries 282 are fed to power control circuits 286, which is controlled by an ON/OFF switch 216. The power control circuits provide power to the central processing unit 260, the digital to analog converters 232 & 234, the servo mechanisms 222 & 224, and the RFID reader 252.

Figure 15:
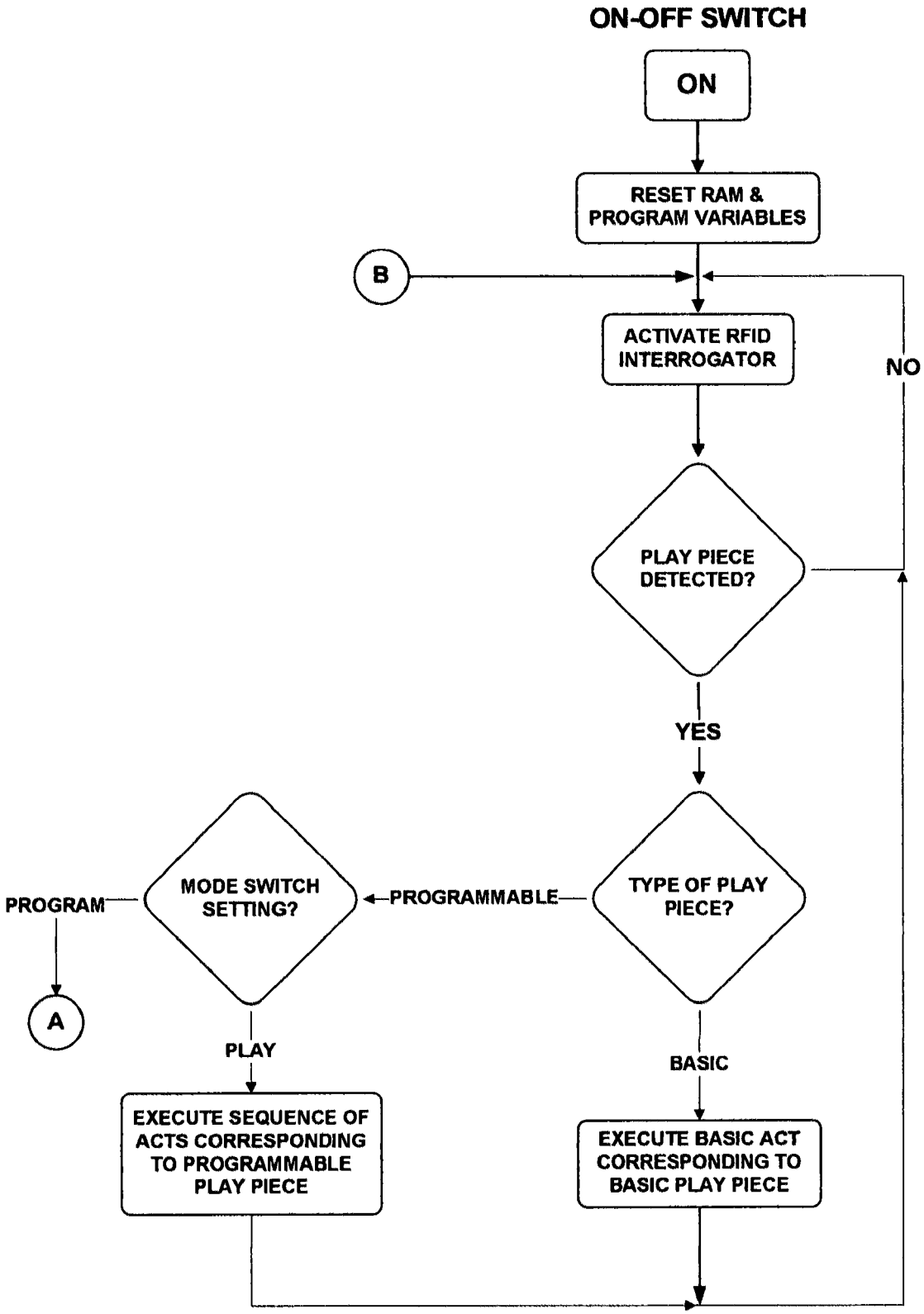
FIGS. 15-16 include a logical flow diagram illustrating the main program functions performed by the microprocessor controlling the toy pet device according to the second alternate embodiment of the invention.
Figure 16:
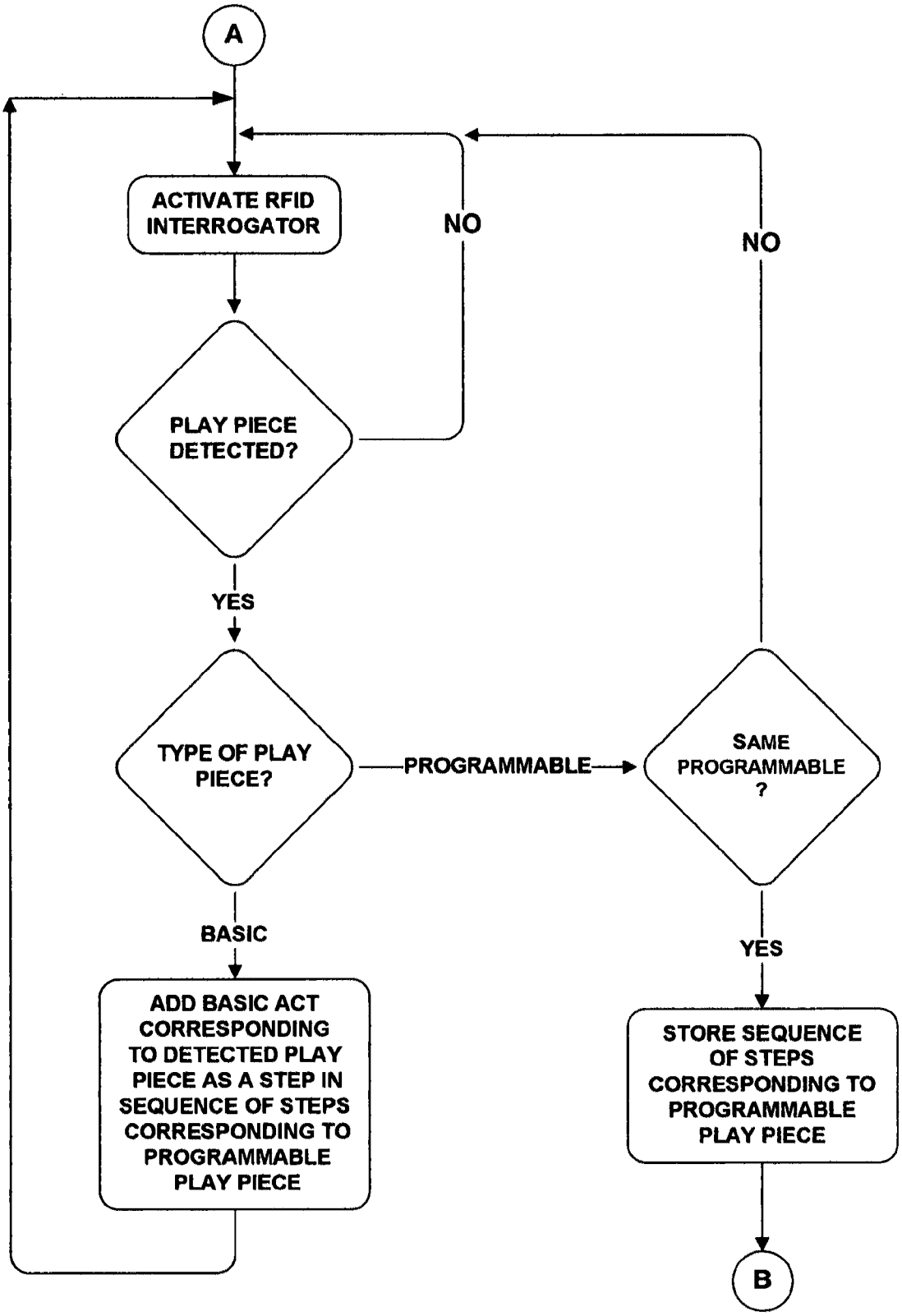

With respect to the operation of this interactive toy pet device, the logic steps utilized for the second alternate embodiment are illustrated in flow diagram form in FIGS. 15 & 16, which interconnect with each other at the places shown in the various figures. Even though specific reference will not be made to this diagram in the following description of the operation of the toy pet device, periodic reference to this diagram may prove to be helpful to the reader hereof.

Referring again to FIG. 14, in order to operate the toy pet device, the player moves the off-on switch 216, located on the toy poet device 210, from the "off" position to the "on" position which causes power to be supplied to all terminals of the toy pet device 210, and which causes a pulse generator 284 to generate a reset pulse. The reset pulse is applied to the central processing unit 260 and causes the central processing unit 260 to clear any data remaining in the RAM 264 and in the audio driver 240 over the common data bus 290. This reset pulse does not affect the data stored in the flash memory 266, including data related to the programmed play pieces.

The control program steps indicated in FIGS. 15 & 16 are then executed to operate the device in either of the two modes described above. If the mode switch 244 is set to the play position, then upon the detection of a play piece, the control program execute the act or acts associated with said play piece. Alternatively, if the mode switch 244 is set to the program position, then the control program stores the sequence of basic interactions selected by the player for the programmable play piece. Said sequence of basic interactions is stored in the Flash memory 266 to ensure that the information remains in memory when the power to the device is turned off. However, upon two successive activations of the reset push button 248, all information related to the programmable play pieces is erased from memory.

The specific steps included in FIGS. 15 & 16 are provided only as an example to demonstrate the second alternate embodiment. A person of ordinary skills in the art will appreciate that alternate flow charts could be utilized to implement this interactive toy pet device. Obviously these flow charts will vary from one another in some degree. However, it is well within the skill of a toy designer to provide particular flow charts for implementing various configurations to provide new interactions using basic interactions as building blocks. It is to be understood that such particular flow charts are within the scope and intent of the current invention. It is also to be understood that the foregoing detailed description, and the specific steps included in FIGS. 15 & 16 have been given for clearness of understanding only, and are intended to be exemplary of the invention while not limiting the invention to the exact steps shown.

Description of a Third Alternate Embodiment

In addition, the objective of the invention can be achieved by a third alternate embodiment of a play set that includes an interactive doll as a primary toy device, and a plurality of clothing and fashion accessories. The doll device includes a RFID interrogator and an associated antenna, and each piece of clothing and fashion accessory has a passive RFID tag with a unique identification code. The doll device, also, includes a microprocessor programmed with intelligence that enables the doll device to memorize combinations of clothing, and fashion accessories presented to it by a player during various play sessions.

Figure 17:
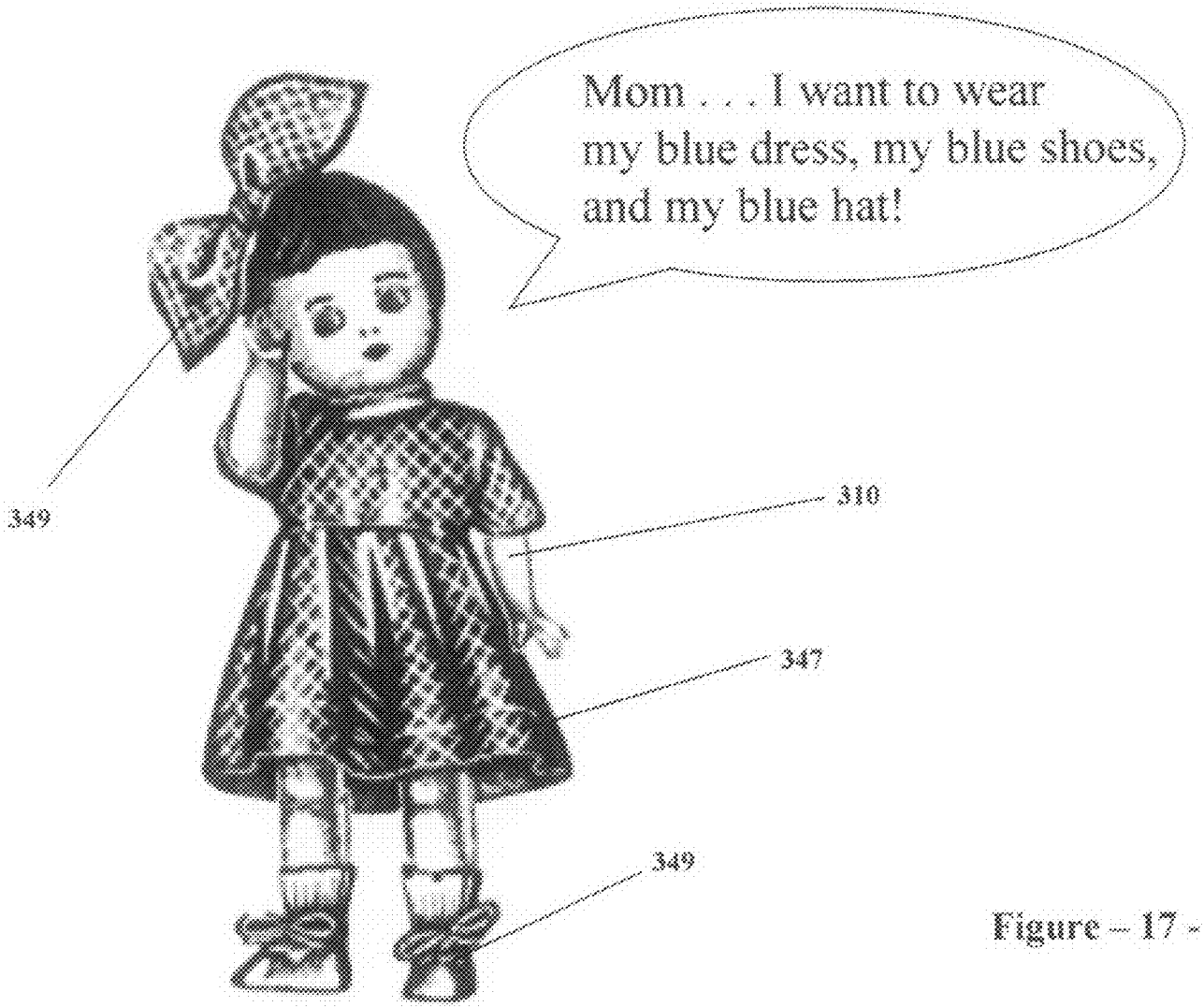
FIG. 17 is a view of the third alternate embodiment showing an interactive doll device with associated clothing and fashion accessories according to the invention.

Referring now to the drawings where the illustrations are for the purpose of describing the third alternate embodiment of the invention, and are not intended to limit the invention hereto, FIG. 17 is an illustration of said primary toy in the form of an interactive doll device 310 in a play set that includes a plurality of clothing and fashion accessories. The doll device is programmed to generate a plurality of verbal interactions that are based on knowledge information related to clothing, fashion accessories and other play pieces associated with the play set. Said knowledge information includes three main categories of data: the description of clothing, fashion accessories, and other items that are "owned" by the doll device; the description of clothing, fashion accessories, and other items that are part of the play set, but are not owned by the doll device, and information related to pre-determined grouping of clothing, fashion accessories, and other items.

The interactions generated by the doll device 310 include generating verbal feed back related to a piece of clothing, or a combination of clothing and accessories; generating verbal requests to acquire a specific piece of clothing, accessory, or an item that is part of the play set, but is not owned by the doll; and generating verbal comments related to a missing piece of clothing or accessory that is part of a pre-determined grouping of clothing and/or accessories, or related to a piece of clothing or accessory that does not belong to said pre-defined grouping.

To establish knowledge information related to said first category, the player is instructed to place each piece of clothing, accessory, or a combination of clothing and accessories, in front of the doll device in a play role, or a play pattern, which informs the doll that the child has purchased new clothing for the doll. The child is also instructed to activate a button 344 on the doll device so that the doll could acknowledge its new clothing and/or fashion accessories. The RFID interrogator within the doll device transmits a modulated radio frequency request signal to energize the RFID tags located on the clothing and/or accessory pieces. In turn, the RFID tags use the radio frequency energy received from the interrogator to reflect back to the interrogator the digital information encoded in the tags. Further, the player is instructed to activate a "dressed" button 346 after dressing up the doll with clothing and accessories.

A microprocessor inside the doll device uses the identification codes received from the RFID interrogator to establish a data base of clothing and accessories that were presented to the doll. This is accomplished by using a lookup table, which is stored in the memory of the doll device as part of its control program, to retrieve the description of clothing and accessories that were scanned by the RFID interrogator. In addition, upon activating the "dressed" button 346, the microprocessor stores information related to the clothing 347 and fashion accessories 349 used by the child to dress up the doll during a play session. The microprocessor uses said stored information to differentiate between clothing on the doll device, and other detected clothing. Further, such information remains in the memory of the doll device even after the power is turned off. If the player undresses the doll during a time period when the doll device is de-energized, then upon turning the power on, the doll device will detect the absence of clothing and/or accessories.

The doll device is programmed to initiate a plurality of interactions related to such clothing. For example, the doll device could generate one of a plurality of pre-determined verbal statements admiring, or commenting on its new clothing. Alternatively, the interactive doll device could generate an interaction requesting the child to dress it with a particular item of clothing, or a specific combination of clothing and accessories. Further, the doll device is programmed to detect a missing piece of clothing, or a missing fashion accessory from a grouping or a clothing set, and is also programmed to request the player to provide said missing piece of clothing or accessory. Also, during game play, the doll device is programmed to provide verbal feed back to the player in the event a piece of clothing, or a piece of fashion accessory, which does not belong to a clothing set, is used to dress up the doll.

New clothing could be in the form of a matched set of individual pieces of clothing, and fashion accessories. For example, a new clothing set could consist of a dress, a matching pair of shoes, a matching hand bag, and a matching hat. In such a case, each piece of clothing has a unique identification code that is stored in the associated RFID tag. Further, the various identification codes that belong to a set of clothing could be linked together in a data base, to identify to the doll device that the associated pieces are part of said set.

In an alternate mode of operation, the microprocessor could include a data base, stored in its read only memory (ROM), and which include descriptive information of available clothing and accessories that are associated with the primary interactive doll device. Such clothing and accessories would be available in the market place, but not yet purchased and presented to the doll device as new clothing. From time to time, and preferably using a random algorithm, the doll device generates an interactive play session, during which it relays to the child its desire to get a specific piece, or set of clothing. Such request would be remembered by the doll device, and the doll device will generate appropriate appreciative comments in the event the child provides the requested clothing or accessories to the doll. Alternatively, the doll device will generate interactions reminding the player of its prior requests.

The above described doll device could be further developed to interact with a similar device, using communication modules such as infra red technology 342, or the like. In such a case each doll device provides verbal interactions related to the clothing worn by the other doll device. One way to implement such interaction is to use infra red communication 342 to identify the dolls to each other, and communicate verbalized statements to each other in order to generate reply statements. Upon the detection of another doll device, using a RFID interrogator, each doll device scans the clothing worn by the other doll device in order to identify said clothing, and to generate an appropriate verbalized comment using predefined scripts stored in the data base for the doll device. The microprocessor is programmed to differentiate between its own clothing, and the clothing worn by another doll. As part of a doll-to-doll interaction, the microprocessor is programmed to memorize clothing associated with the other doll device, and to generate interactions at a future play session related to such clothing.

As would be appreciated by a person skilled in the art, the above described concept of a doll device could be expanded beyond clothing and fashion accessories. For example, the interactive doll device could be associated with a plurality of non-clothing accessories such as toys, pieces of furniture, pets, or the like. Similar to the clothing and fashion accessories, such additional accessories could be presented to the doll device as new items, or could be stored in a data base within the doll device.

Figure 18:
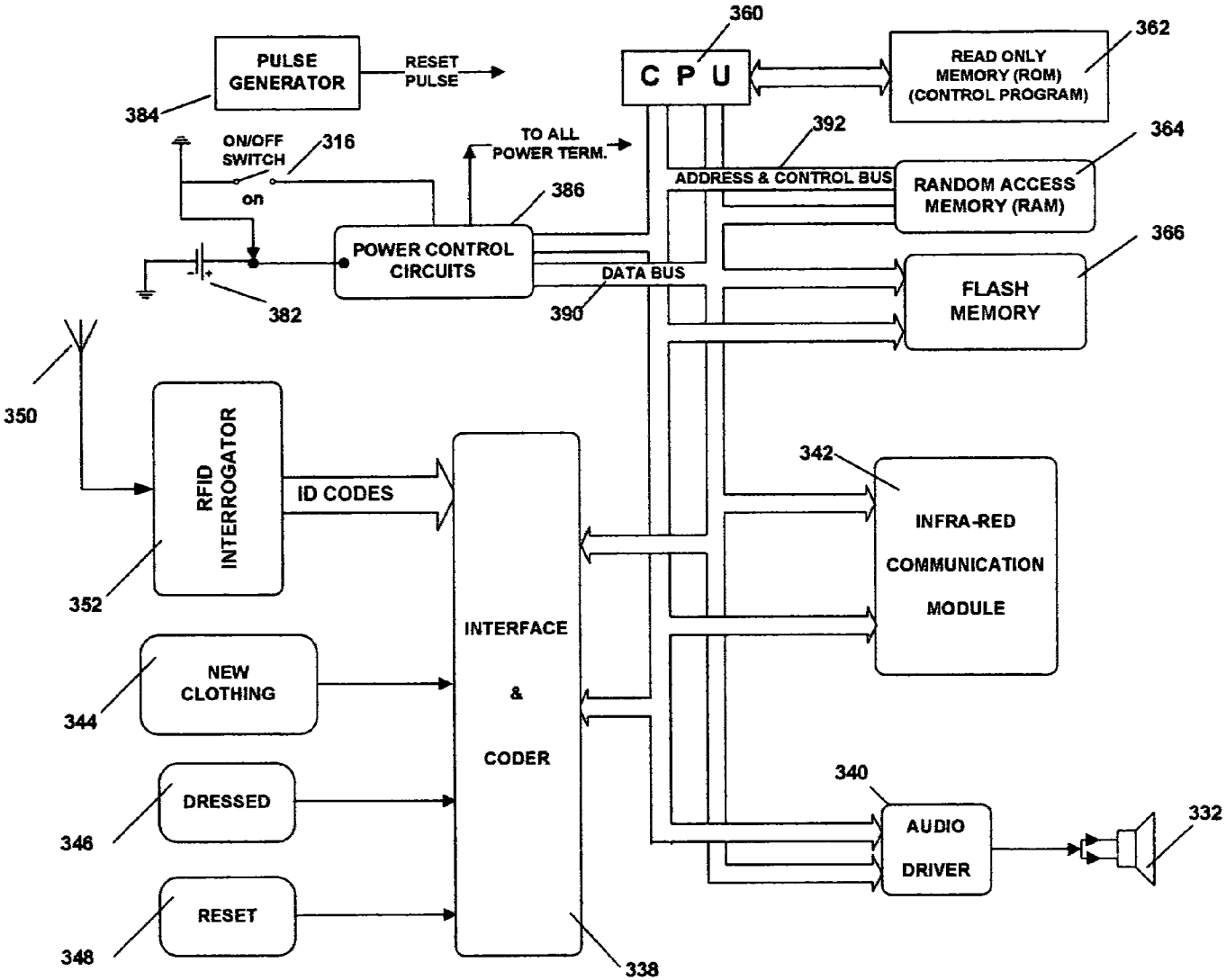
FIG. 18 is a block diagram of the microprocessor circuitry used to control the interactive doll device according to the third alternate embodiment of the invention.
Figure 19:
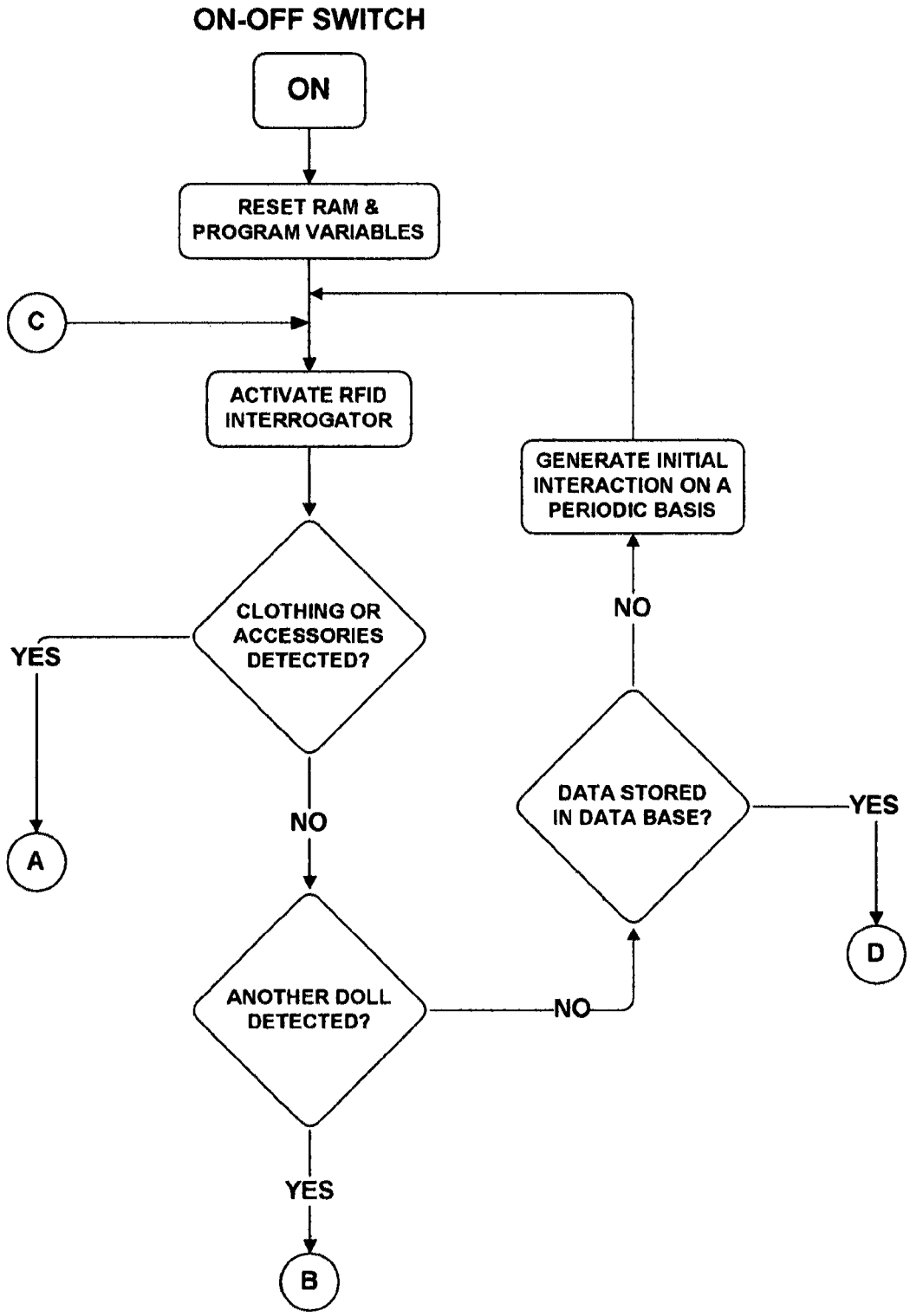
FIGS. 19-24 include a logical flow diagram illustrating the main program functions performed by the microprocessor controlling the interactive doll device according to the third alternate embodiment of the invention.
Figure 20:
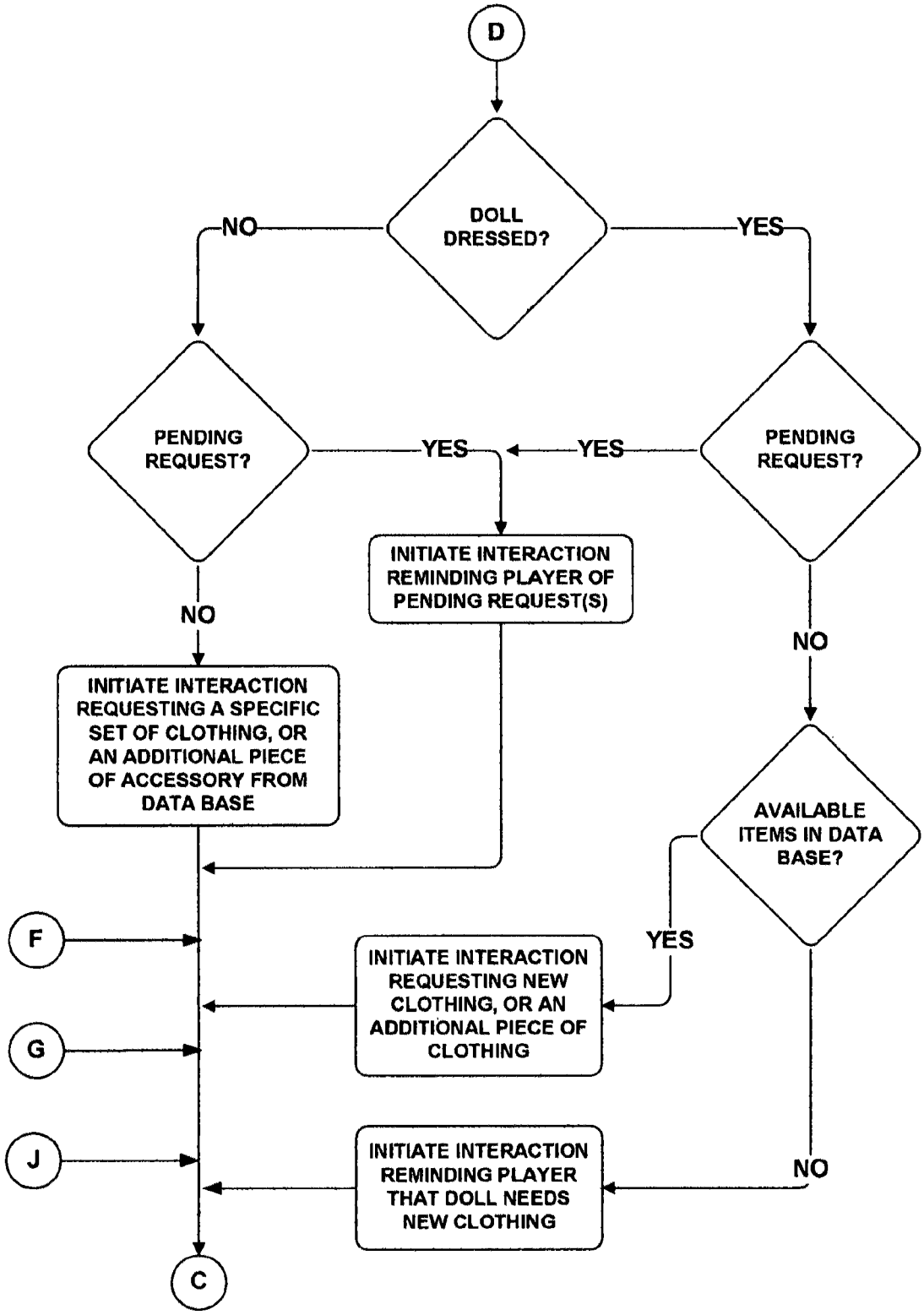
Figure 21:
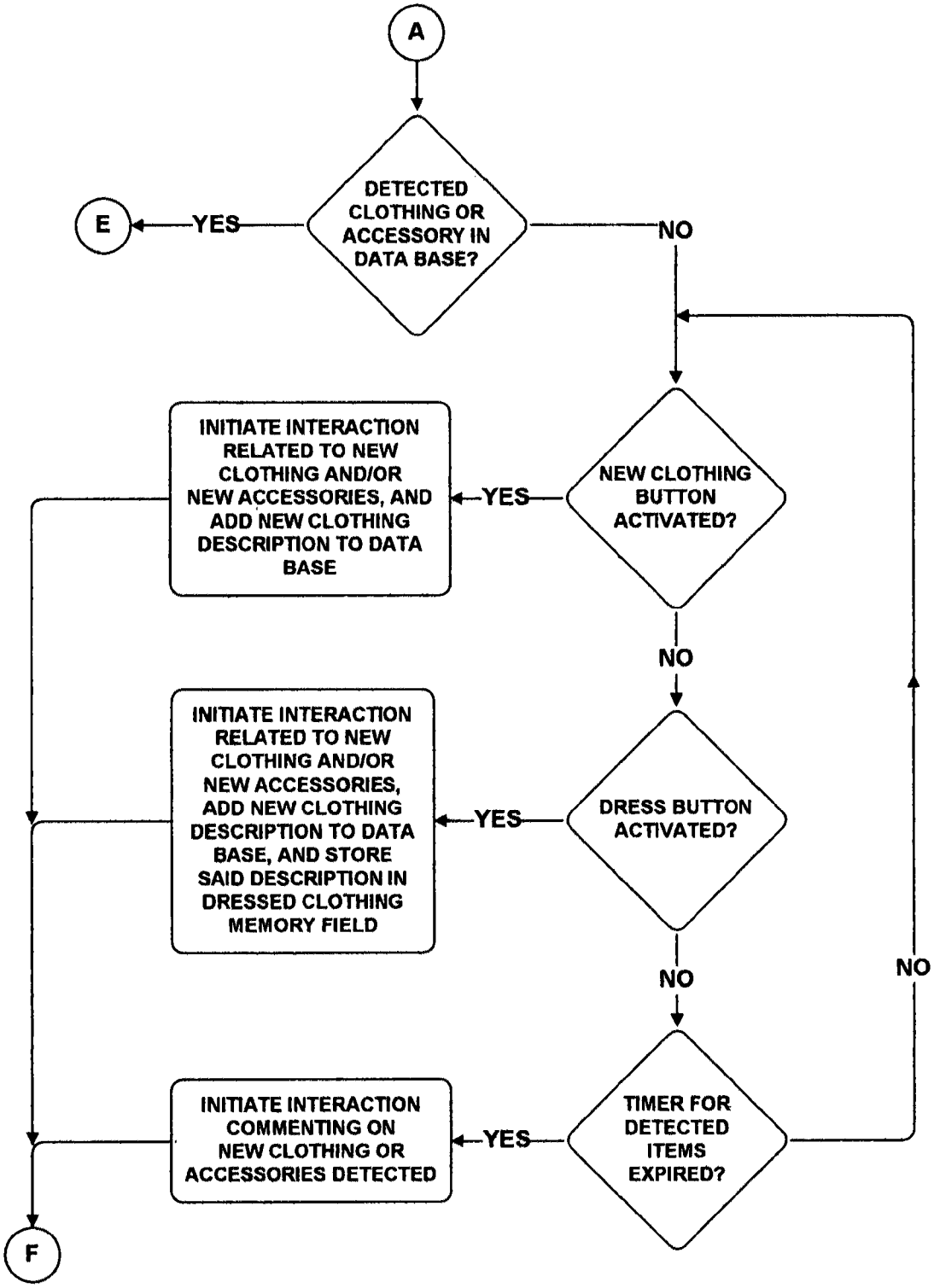
Figure 22:
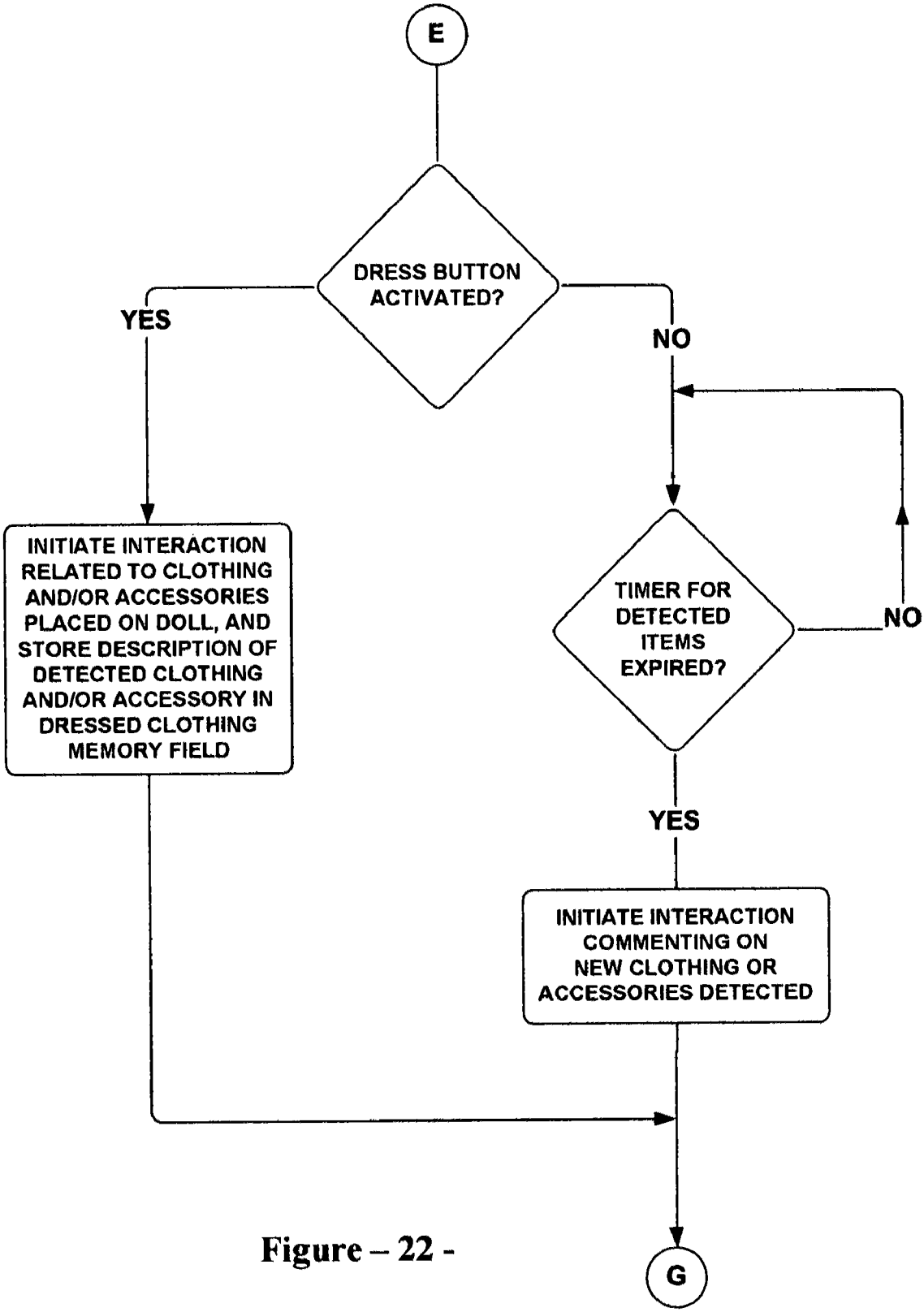
Figure 23:
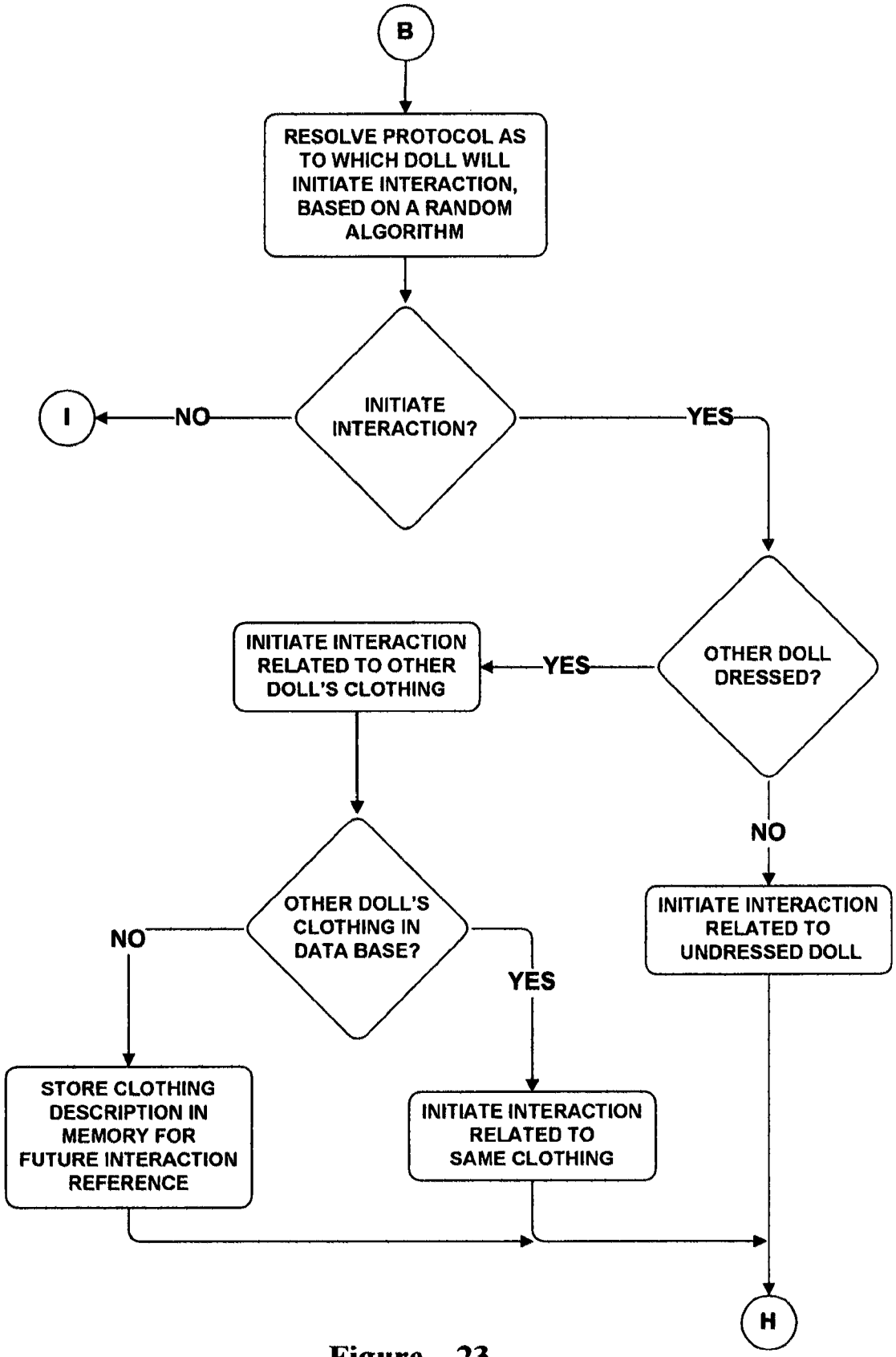
Figure 24:
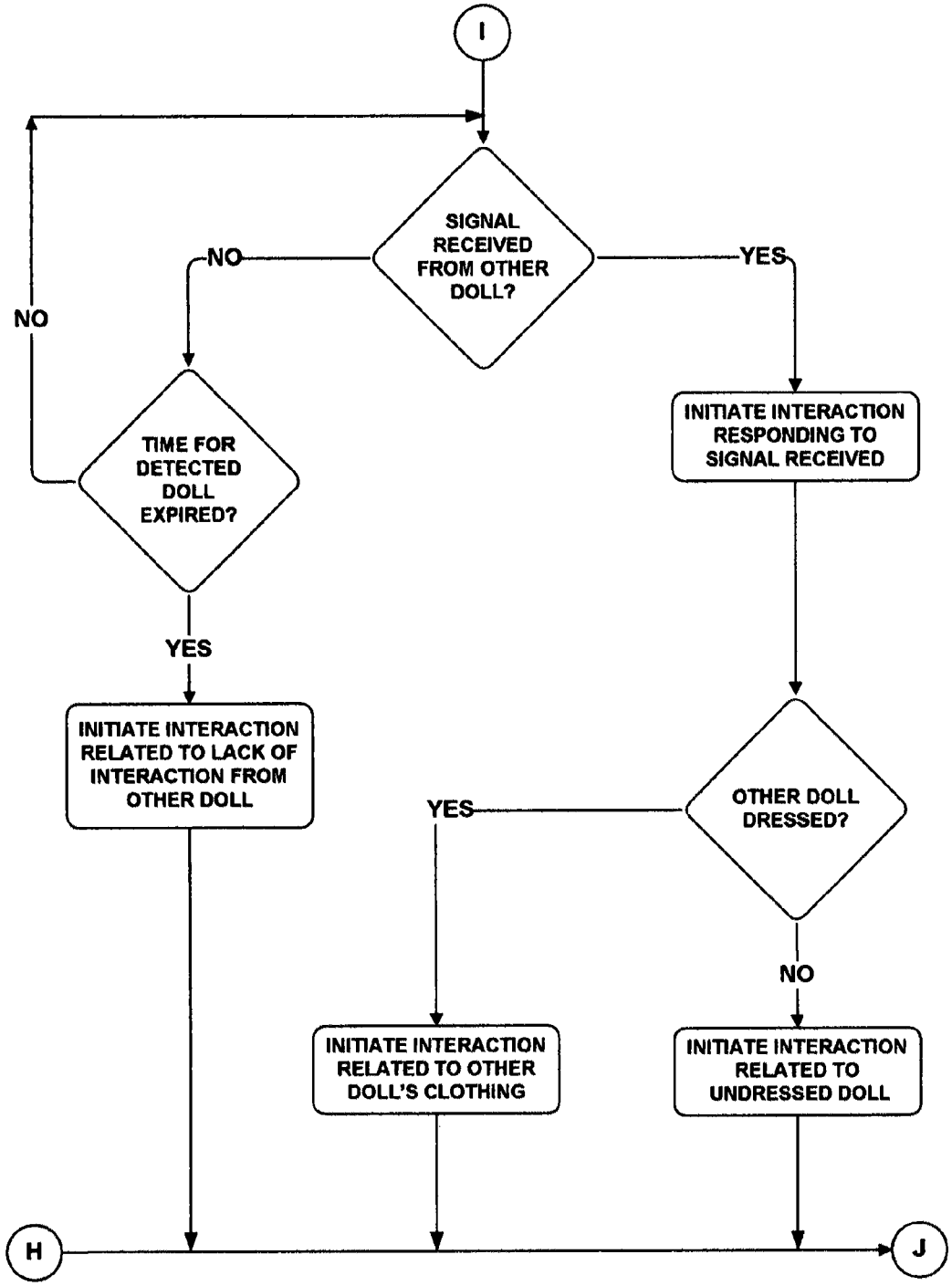

A block diagram of the control circuitry for the interactive doll device 310 is illustrated in FIG. 18. This control circuitry includes a central processing unit 360 having a read only memory (ROM) 362, where the control program resides, a removable FLASH memory 366, a random access memory (RAM) 364, an interface and coding device 338, a memory decoder driver 342, and audio interface and control circuits (audio driver) 340. The interface and coding device 338 is used as input interface between the RFID interrogator 352, the "NEW CLOTHING" push button 344, the "DRESSED" push button 346, the "RESET" switch 348, and the central processing unit 360. Alternatively, the audio driver 340 is used as output interface between the central processing unit 360 and the loudspeaker 332. A common address and control bus 392, and a separate common data bus 390 are used to interconnect the central process unit 360 with the interface and coding device 338, the audio driver 340, the infra red communication module 342, the read only memory (ROM) 362, the random access memory (RAM) 364, and the flash memory 366.

It should be noted that the above description of the control circuit of the device is provided as an example for illustration purposes only, and is not intended to limit the present invention. As would be obvious to those skilled in the art, a toy designer would most likely select a micro-controller with built-in audio driver to control the interactive doll device. Such micro-controller may include I/O ports that can be configured as input or output ports. The I/O ports of the micro-controller can be used to connect the various input and output devices directly to the micro-controller without the need for any interface and coding devices, or memory decoder drivers. Such micro-controllers are well known to those skilled in the art.

The central processing unit 360 controls the flow of all information throughout the entire interactive doll device under the direction of the control program. The control program resides in the read only memory (ROM) 362. A plurality of dry cell batteries 382 is positioned in a compartment within the doll device. These batteries 382 are fed to power control circuits 386, which is controlled by an ON/OFF switch 316. The power control circuits provide power to the central processing unit 360, the infra red communication module 342, and the RFID reader 352.

With respect to the operation of this interactive doll device, the logic steps utilized for the third alternate embodiment are illustrated in flow diagram form in FIGS. 19 through 24, which interconnect with each other at the places shown in the various figures. Even though specific reference will not be made to this diagram in the following description of the operation of the doll device, periodic reference to this diagram may prove to be helpful to the reader hereof.

Referring again to FIG. 18, in order to operate the interactive doll device, the player moves the off-on switch 316, located on the doll device 310, from the "off" position to the "on" position which causes power to be supplied to all terminals of the doll device 310, and which causes a pulse generator 384 to generate a reset pulse. The reset pulse is applied to the central processing unit 360 and causes the central processing unit 360 to clear any data remaining in the RAM 364 and in the audio driver 340 over the common data bus 390. This reset pulse does not affect the data stored in the flash memory 366, including data related to the clothing used to dress the doll device.

The control program steps indicated in FIGS. 19 through 24 are then executed to select one of a plurality of interactions using a plurality of decision blocks. The control program initiates an interaction based on a number of factors, including the detection of new clothing/fashion accessories, the dress status of the doll, the detection of a similar doll, and the information stored in the data base. An interaction by the doll device is in the form of a verbal communication, which conveys a request, expresses gratitude for receiving new clothing, comments on clothing and/or accessories, and/or reminds the player of prior requests. The selection of an interaction, also, includes a random element to provide different playing sessions. Further, the control program employs data stored from previous interactions to generate new interactions. The specific steps included in FIGS. 19 through 24 are provided only as an example to demonstrate the third alternate embodiment. A person of ordinary skills in the art will appreciate that alternate flow charts could be utilized to implement this interactive doll device. Obviously these flow charts will vary from one another in some degree. However, it is well within the skill of a toy designer to provide particular flow charts for implementing various interactions related to clothing and fashion accessories. It is to be understood that such particular flow charts are within the scope and intent of the current invention. It is also to be understood that the foregoing detailed description, and the specific steps included in FIGS. 19 through 24 have been given for clearness of understanding only, and are intended to be exemplary of the invention while not limiting the invention to the exact steps shown.

It should also be noted that the use of interactions in the form of verbal communication is set forth for the purpose of describing the third alternate embodiment, and is not intended to limit the invention herein. As would be appreciated by a person skilled in the art, other form of interactions could be used. For example, a mechanized doll could be used to provide different facial expressions during various interactions. The doll would portray a happy face after receiving new clothing, or would have a surprise facial expression upon detecting another doll wearing the same clothing set, etc.

It should be noted that a person skilled in the art could use the teaching of this invention to develop additional alternate embodiments. Such alternate embodiments would be based on intelligent play sets that employ different primary toys, action figures, and/or playing pieces. Further, such intelligent play sets could be based on the concepts of identifying and/or tracking action figures/playing pieces during game play, providing interactions based on the specific action figures, playing pieces, or combinations thereof, used by the player, providing new interactions based on the history of how a player has interacted with the play set during previous play sessions, and programming or building new interactions using basic interactions as building blocks. It should be clearly understood that such additional alternate embodiments fall within the scope of this invention, and its claims.

In addition, the logical flow diagrams shown in FIGS. 3-6, 9-12, 15-16 & 19-24 are provided herein for the purpose of describing the preferred and alternate embodiments. A person of ordinary skills in the art will appreciate that alternate programs may be utilized to implement these flow diagrams. Obviously these programs will vary from one another in some degree. However, it is well within the skill of the computer programmer to provide particular programs for implementing each of the steps of the flow diagrams disclosed herein. It is also to be understood that the foregoing detailed description has been given for clearness of understanding only, and is intended to be exemplary of the invention while not limiting the invention to the exact embodiment shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

What is claimed and desired to be secured by letters of patent is:

1. An interactive play set, comprising:
A mirror device;
a plurality of action figures;
a plurality of playing pieces;
means for generating a plurality of interactions between the mirror device and the action figures;
means for identifying an action figure and associated playing pieces to the mirror device;
means for storing the history of interactions between the action figures and the mirror device during a play session; and
means for generating an action by the mirror device based on said history of interactions.

2. An interactive play set as recited in claim 1 further comprising an input control mechanism to enable a player to interact with the mirror device.

3. An interactive play set as recited in claim 1 wherein said means for generating a plurality of interactions includes means for the mirror device to generate verbal interactions.

4. An interactive play set as recited in claim 1 wherein said means for generating a plurality of interactions includes means for the action figures to generate verbal interactions.

5. An interactive play set as recited in claim 1 wherein said plurality of play pieces includes a plurality of clothing and fashion accessories.

6. An interactive play device as recited in claim 5, wherein said means for generating an action for the mirror device includes means for evaluating the action figures based on associated clothing and fashion accessories.

7. An interactive play set as recited in claim 1, wherein said means for identifying an action figure and associated playing pieces to the mirror device includes radio frequency identification reader and associated tags.

8. An interactive play set as recited in claim 1, wherein said mirror device has a reflective surface.

9. An interactive play set as recited in claim 8, wherein said reflective surface becomes transparent upon the activation of a light emitting module within the mirror device.

10. An interactive play set, comprising:
a plurality of action figures;
a plurality of playing pieces;
a mirror device comprising a microprocessor with a computer-readable medium encoded with a computer program that controls the operation of the mirror device;
a segment of the computer program segment that generates a plurality of interactions between the mirror device and the action figures;
means for identifying an action figure and associated playing pieces to the mirror device;
computer memory included in the mirror device to store information related to the identities of the action figures and associated playing pieces that interacted with the mirror device during a play session; and
another segment of the computer program that generates an action for the mirror device based on said stored information.

11. An interactive play set as recited in claim 10 further comprising an input control mechanism to enable a player to interact with the mirror device.

12. An interactive play set as recited in claim 10 wherein said plurality of interactions includes verbal interactions by the mirror device.

13. An interactive play set as recited in claim 10 wherein said plurality of interactions includes verbal interactions by at least one action figure.

14. An interactive play set as recited in claim 10 wherein said plurality of play pieces includes a plurality of clothing and fashion accessories.

15. An interactive play device as recited in claim 14, wherein said action for the mirror device includes evaluating the action figures based on associated clothing and fashion accessories.

16. An interactive play device as recited in claim 14, wherein said action for the mirror device includes critiquing the clothing and fashion accessories of action figures.

17. An interactive play set as recited in claim 10, wherein said means for identifying an action figure and associated playing pieces to the mirror device includes radio frequency identification reader and associated tags.

18. An interactive play set as recited in claim 10, wherein said means for identifying an action figure and associated playing pieces to the mirror device includes infra red devices.

19. An interactive play set as recited in claim 10, wherein said mirror device has a reflective surface.

20. An interactive play set as recited in claim 19, wherein said reflective surface becomes transparent upon the activation of a light emitting module within the mirror device.

21. An interactive play set, comprising:
a plurality of action figures;
a plurality of clothing and fashion accessories;
a mirror device comprising a microprocessor with a computer-readable medium encoded with a computer program that controls the operation of the mirror device;
a segment of the computer program that generates a plurality of interactions between the mirror device and the action figures;

radio frequency identification reader and associated tags for identifying an action figure and associated clothing and fashion accessories to the mirror device;

computer memory included in the mirror device to store the history of interactions between the action figures and the mirror device during a play session; and another segment of the computer program that generates an action for the mirror device based on said history of interactions.

22. An interactive play set as recited in claim 21 further comprising an input control mechanism to enable a player to interact with the mirror device.

23. An interactive play set as recited in claim 21 wherein said plurality of interactions includes verbal interactions by the mirror device.

24. An interactive play set as recited in claim 21 wherein said plurality of interactions includes verbal interactions by at least one action figure.

25. An interactive play set as recited in claim 21, wherein said mirror device has a reflective surface.

26. An interactive play set as recited in claim 25, wherein said reflective surface becomes transparent upon the activation of a light emitting module within the mirror device.

27. An interactive play set, comprising:

at least one action figure;

a plurality of clothing and fashion accessories;

a mirror device comprising a microprocessor with a computer-readable medium encoded with a computer program that controls the operation of the mirror device;

a communication module to identify an action figure and associated clothing and fashion accessories to the mirror device; and a segment of the computer program that generates an interaction based on the combination of clothing the fashion accessories associated with an action figure.

28. An interactive play set as recited in claim 27, further comprising an input control mechanism to enable a player to interact with the mirror device.

29. An interactive play set as recited in claim 27 wherein said interaction includes a verbal interaction by the mirror device.

30. An interactive play set as recited in claim 27, wherein said mirror device has a reflective surface.

31. An interactive play set as recited in claim 30, wherein said reflective surface becomes transparent upon the activation of a light emitting module within the mirror device.

32. An interactive play set, comprising:

a plurality of action figures;

a plurality of clothing and fashion accessories;

a mirror device comprising a microprocessor with a computer-readable medium encoded with a computer program that controls the operation of the mirror device;

a segment of the computer program that generates a plurality of verbal interactions between the mirror device and the action figures;

radio frequency identification reader and associated tags for identifying an action figure and associated clothing and fashion accessories to the mirror device;

computer memory included in the mirror device to store information related to action figures identities and associated clothing and fashion accessories; and another segment of the computer program that generates an action for the mirror device based on said stored information.

33. An interactive play set as recited in claim 32, further comprising an input control mechanism to enable a player to interact with the mirror device.

34. An interactive play set, comprising:

a plurality of action figures;

a plurality of clothing and fashion accessories;

a mirror device comprising a microprocessor with a computer-readable medium encoded with a computer program that controls the operation of the mirror device;

a segment of the computer program that generates a plurality of interactions between the mirror device and the action figures;

means for identifying an action figure and associated clothing and fashion accessories to the mirror device;

computer memory included in the mirror device to store information related to action figures identities and associated clothing and fashion accessories; and another segment of the computer program that evaluates the action figures based on the associated clothing and fashion accessories.

35. An interactive play set as recited in claim 34, further comprising an input control mechanism to enable a player to interact with the mirror device.

* * * * *